US007367957B2

(12) United States Patent
Huang et al.

(10) Patent No.: US 7,367,957 B2
(45) Date of Patent: May 6, 2008

(54) VIBRATION TRAINING APPARATUS FOR LINEARLY CHANGING VIBRATION AMPLITUDE

(76) Inventors: Cheng-Hsun Huang, No. 27-8, Cunsi Lane, Fun an Village, Sioushuei Township, Changhua Hsien (TW); Yu-Chu Chen, No. 27-8, Cunsi Lane, Fun an Village, Sioushuei Township, Changhua Hsien (TW); David Shih, No. 27-8, Cunsi Lane, Fun an Village, Sioushuei Township, Changhua Hsien (TW)

( * ) Notice: Subject to any disclaimer, the term of this patent is extended or adjusted under 35 U.S.C. 154(b) by 0 days.

(21) Appl. No.: 11/645,168

(22) Filed: Dec. 26, 2006

(65) Prior Publication Data

US 2007/0225622 A1 Sep. 27, 2007

(30) Foreign Application Priority Data

Mar. 21, 2006 (TW) ..... 95109609 A

(51) Int. Cl.

| | |
|---|---|
| ***A61H 1/00*** | (2006.01) |
| ***A61H 1/02*** | (2006.01) |
| ***A61H 5/00*** | (2006.01) |
| ***A61H 7/00*** | (2006.01) |
| ***A61H 19/00*** | (2006.01) |

(52) U.S. Cl. ..... 601/31; 601/23; 601/29; 601/49; 601/87; 601/93; 601/100; 601/101; 601/104

(58) Field of Classification Search ..... 601/23, 601/24, 27, 29, 30–32, 46, 49, 50, 51, 53, 601/69, 84–87, 89, 90, 93, 97, 98, 100, 101, 601/104; 482/51–52

See application file for complete search history.

(56) References Cited

U.S. PATENT DOCUMENTS

| | | | | |
|---|---|---|---|---|
| 3,540,436 | A * | 11/1970 | Hueftle, Jr. | 601/35 |
| 5,443,439 | A * | 8/1995 | Ohshita | 601/90 |
| 2005/0033203 | A1 * | 2/2005 | Son | 601/98 |
| 2006/0155221 | A1 * | 7/2006 | Kim | 601/29 |

* cited by examiner

*Primary Examiner*—Justine R. Yu
*Assistant Examiner*—Kristen C. Matter
(74) *Attorney, Agent, or Firm*—Rosenberg, Klein & Lee

(57) ABSTRACT

A vibration training apparatus includes a base, a swinging link rod module and a driving mechanism. The swinging link rod module installed on the base has a driving mechanism for driving several swinging link rods for a link rod movement. An eccentric transmission shaft driven by a motor drives the swinging link rod module to produce a linear vibration during the swinging process, and matches with the rotation speed of the motor to drive a support stand to produce vertically up-and-down displacements with vibrations of different frequencies. An adjusting device can be installed between the swinging link rod module and the base for changing the swinging amplitude of the swinging link rod module, such that the driving mechanism can drive the swinging link rod module to linearly change the vibration amplitude and achieve a whole-body vibration effect to stimulate internal organs and improve muscle strengths and blood circulations.

7 Claims, 24 Drawing Sheets

(A)

(B)

(A)

(B)

(C)

(A)

(B)

(C)

(D)

(A)

(B)

(C)

(D)

(A)

(B)

(A)

(B)

(B)

(A)

VIBRATION TRAINING APPARATUS FOR LINEARLY CHANGING VIBRATION AMPLITUDE

FIELD OF THE INVENTION

The present invention relates to a whole-body vibration training apparatus capable of linearly changing its vibration amplitude, and more particularly to an apparatus for driving a support stand to produce linear vibrations with different frequencies and changing the swinging amplitude of a swinging link rod module by an adjusting mechanism, so as to change the vibration amplitude and achieve the resonant effect for human organs and muscles.

BACKGROUND OF THE INVENTION

Referring to FIG. 11 for a traditional passive repeated muscle strength improvement machine, the machine includes a treadle 61 in a weight training equipment stand 60 and a cam 62 installed under the treadle 61, and the treadle 61 can be moved up and down repeatedly by a mechanical transmission method and ascended and descended by rotating the cam 62, such that an exerciser continuously bears a passive exercising load and engages in a plyometric and centrifugal contraction muscle strength training that consumes a great deal of motor units in a short time to generate larger muscle strength and power.

Referring to FIGS. 12 and 13 for another traditional left, right, up and down vibration training machine, the machine includes a treadle 76 on a machine body 70, a center shaft 75 installed at the middle of the bottom of the treadle 76, a link arm 74 installed at an end of the machine body 70 and pivotally integrated with a motor 71 of the machine body 70, a link wheel 72 of an eccentric link wheel, and a driving arm 73, such that both left and right ends of the treadle 76 can be inclined, ascended and descended repeatedly to produce up-and-down vibrations on both left and right ends of the treadle 76 similar to those of a seesaw and assist users to exercise their body sideway for a better exercising effect.

SUMMARY OF THE INVENTION

In view of the shortcomings of the prior art, the inventor of the present invention based on years of experience in the fitness equipment related industry to conduct extensive researches and experiments, and finally invented a whole-body vibration training apparatus capable of linearly changing its vibration amplitude.

Therefore, it is a primary objective of the invention is to provide a whole-body vibration training apparatus comprising a base, a driving mechanism and a swinging link rod module. The swinging link rod module is pivotally connected to the base, and the driving mechanism is comprised of a motor, a transmission shaft and a driving member. The axle center of the motor is connected with a pulley on the transmission shaft by another pulley and a belt, and both ends of the transmission shaft have an eccentric shaft pivotally coupled to a driving member, and the bottom of each driving member is pivotally connected to a swinging link rod of the swinging link rod module. The swinging link rod module comprises a plurality of swinging link rods connected with each other for pivotally connecting the driving member and the first swinging link rod. Another end of the first swinging link rod is pivotally connected to a driving member, and another end of the driving member is pivotally connected to a second swinging link rod, such that another end of the second swinging link rod is pivotally connected to a third swinging link rod and a link member. Another end of the link member is pivotally connected to a fourth swinging link rod, and the upper external side of the third swinging link rod and another end of the fourth swinging link rod are pivotally connected to the upper external side of another link member and a rectangular support stand. The operation of the driving mechanism drives the swinging link rod module to produce a link rod movement, and the link rod movement produces linear vibrations and matches with the rotation speed of the motor to drive a support stand to produce vertically up-and-down displacements with vibrations of different frequencies.

DETAILED DESCRIPTION OF THE PREFERRED EMBODIMENTS

Figure 1:
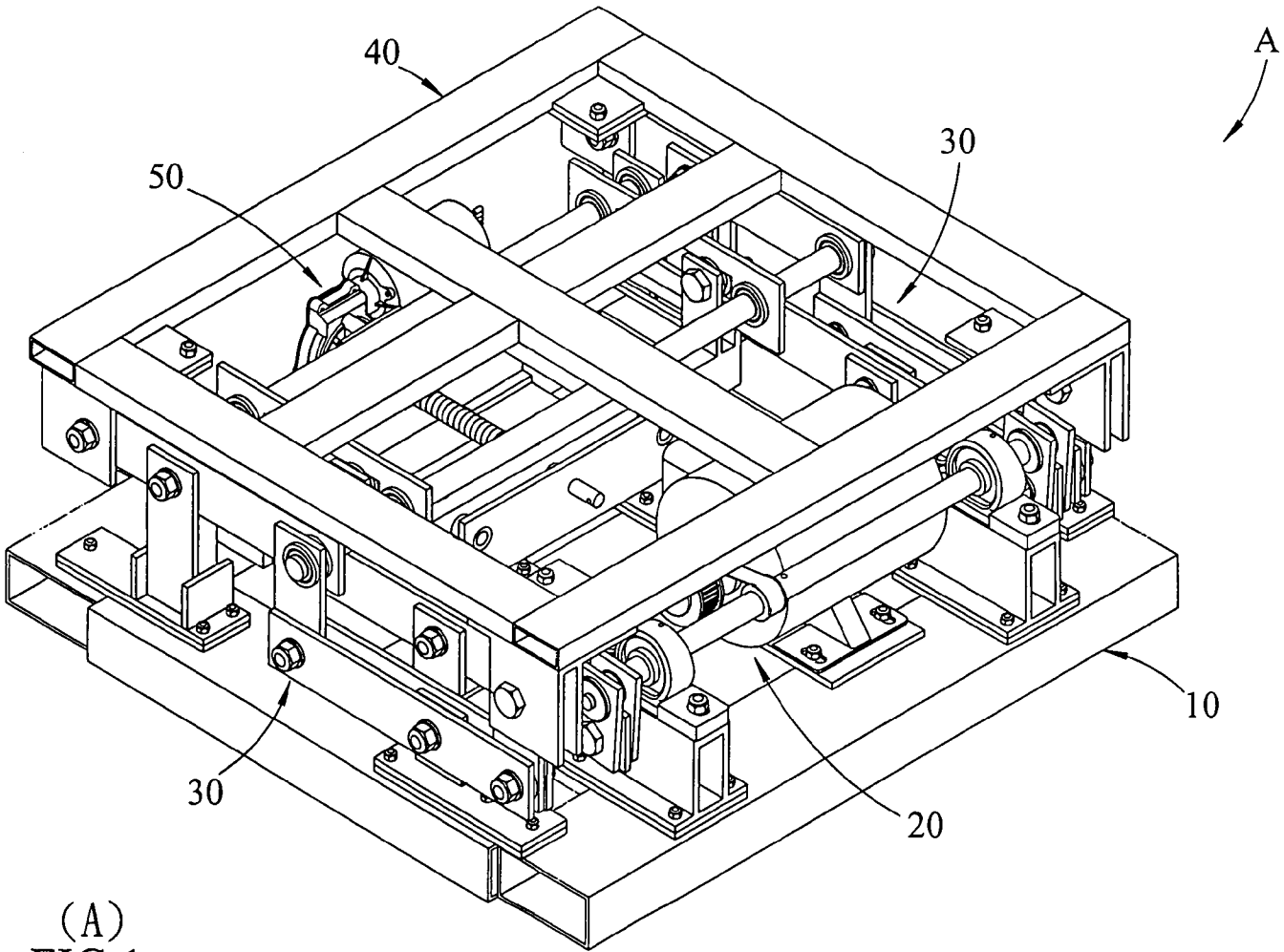
FIG. 1A is a front view of an assembled vibration fitness equipment of the present invention.
FIG. 1B is a rear view of an assembled vibration fitness equipment of the present invention.
Figure 1:
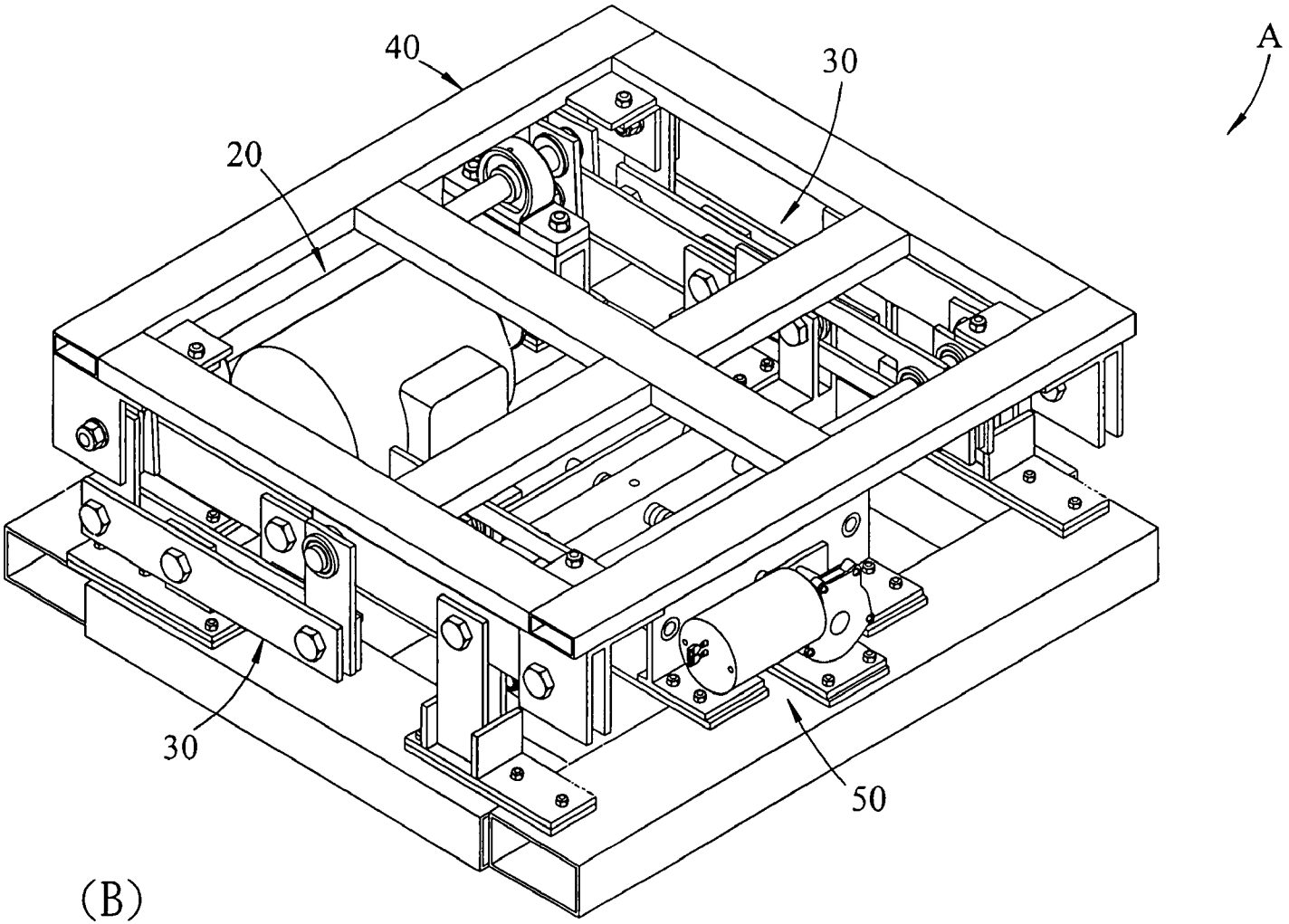
Figure 2:
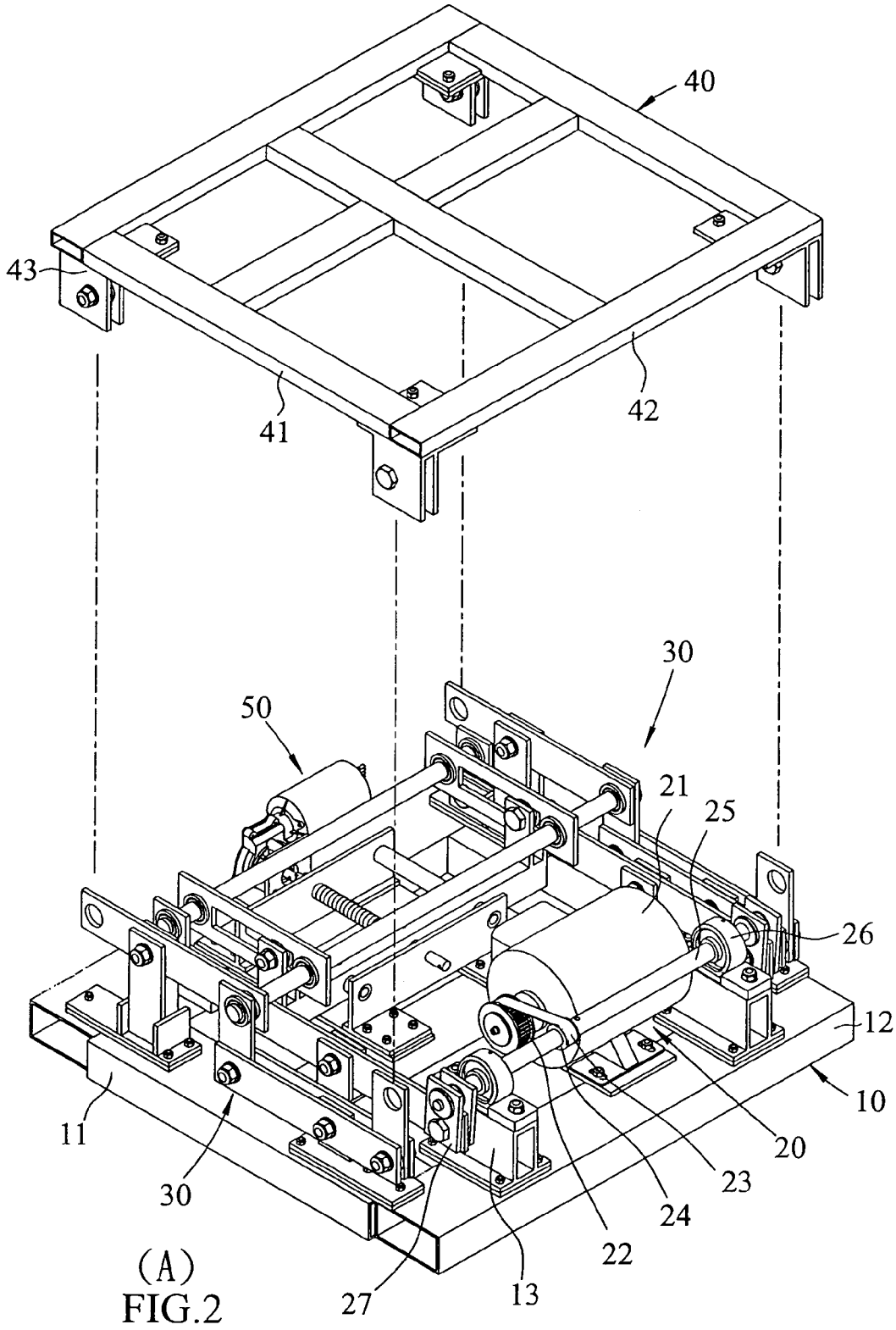
FIG. 2A is an exploded view of a base and a support stand of a vibration fitness equipment of the present invention.
FIG. 2B is an exploded view of a base, a swinging link rod module and a support stand of a vibration fitness equipment of the present invention.
FIG. 2C is an exploded view of a swinging link rod module of a vibration fitness equipment of the present invention.
Figure 2:
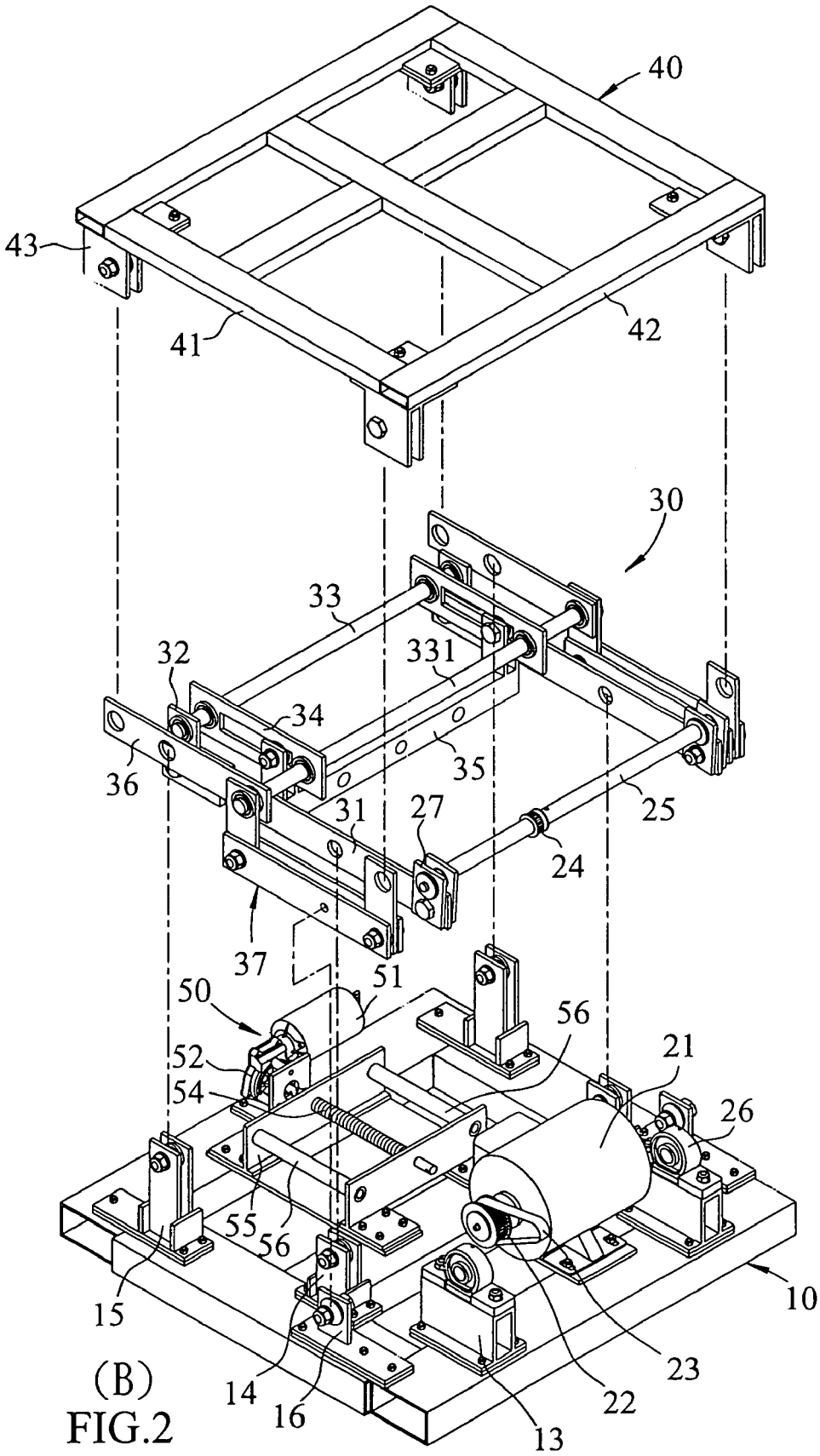
Figure 2:
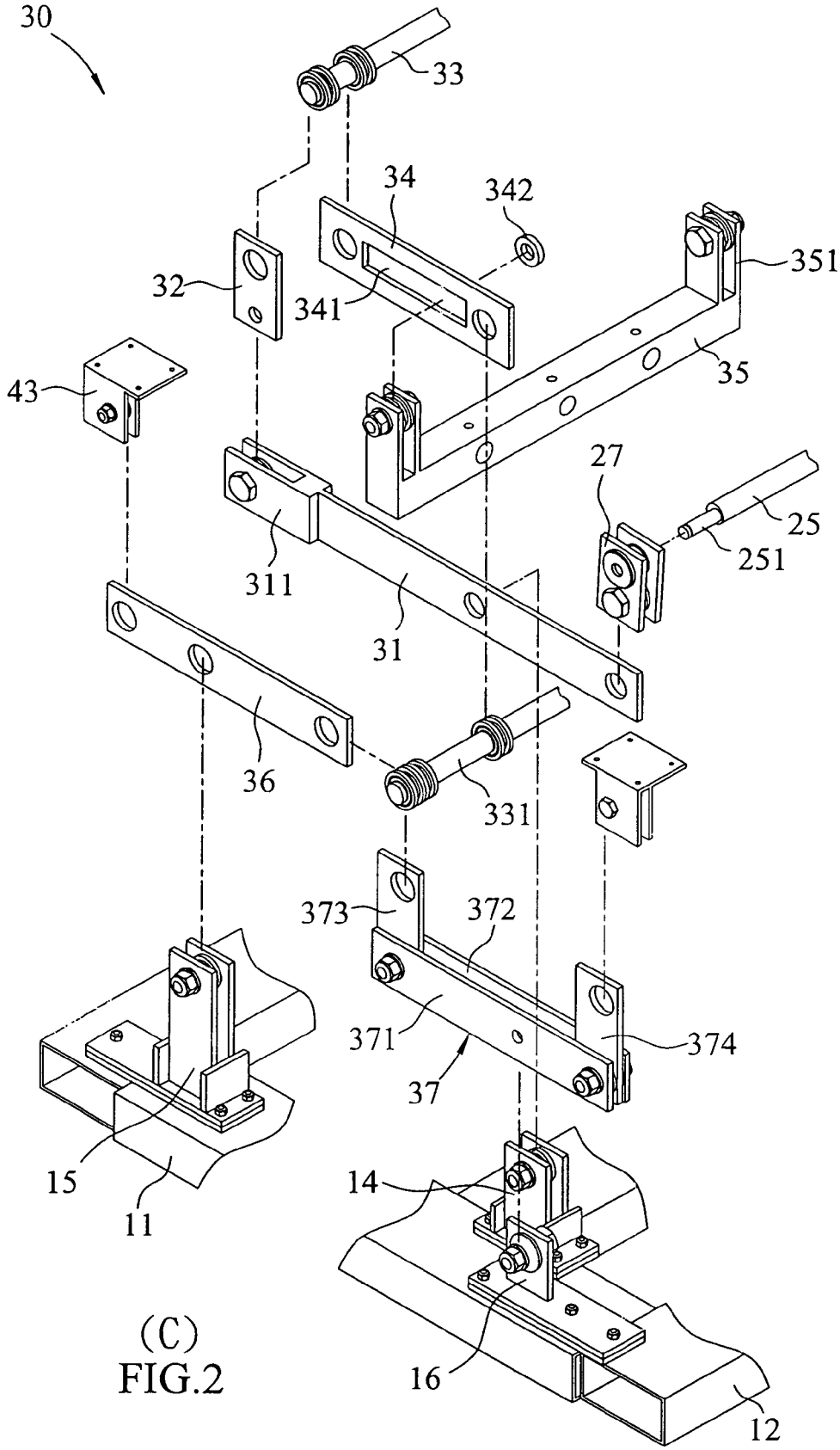
Figure 3:
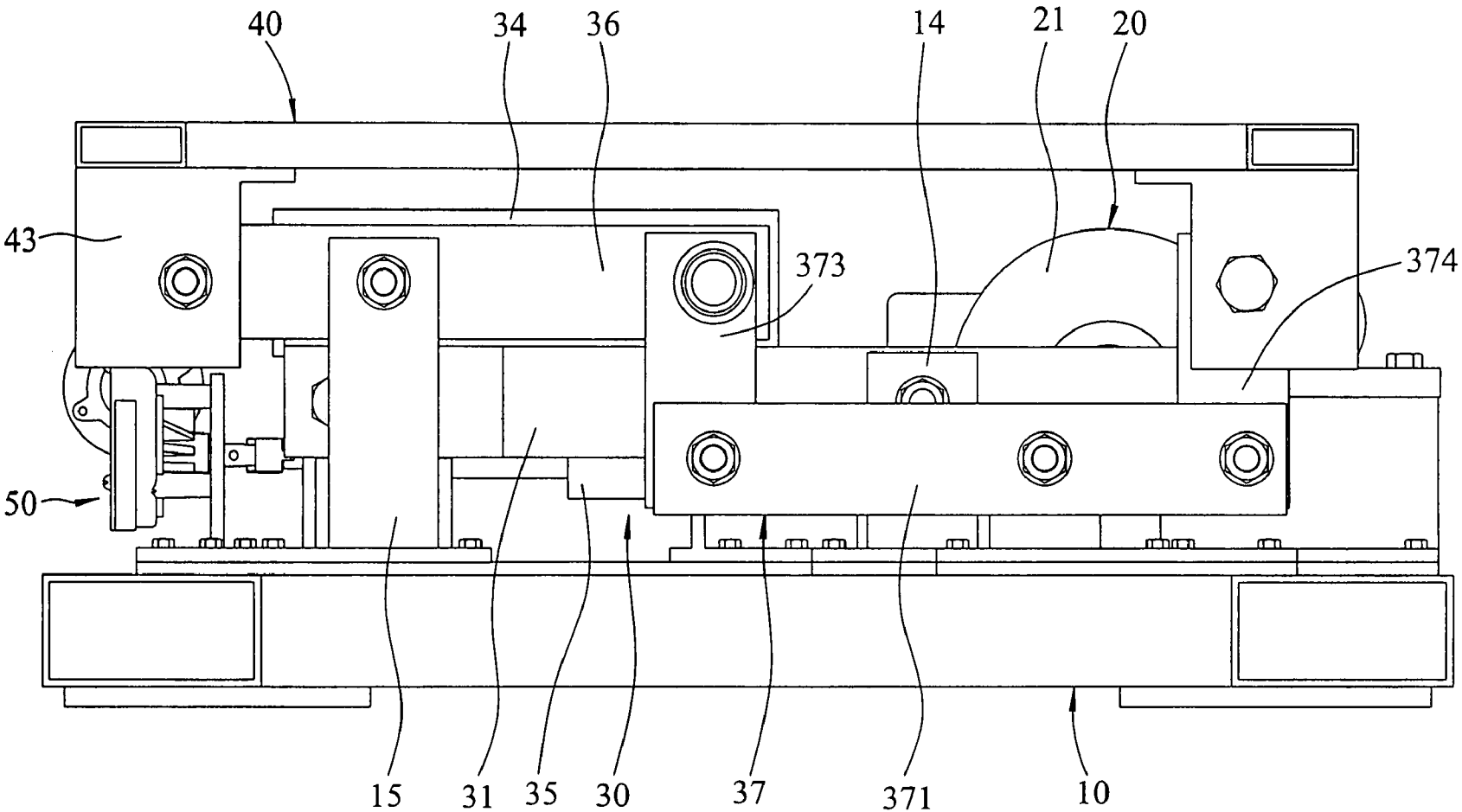
FIG. 3 is a front view of a vibration fitness equipment of the present invention.

Referring to FIGS. 1A, 1B, 2A, 2B, 2C and 3 for a whole-body vibration training apparatus capable of linearly changing its vibration amplitude A, the apparatus comprises the following elements:

A base 10 is comprised of a plurality of transversal frames 11 and longitudinal frames 12, and a plurality of pivotal bases disposed on the base for pivotally connecting a driving mechanism 20 and a swinging link rod module 30.

Figure 4:
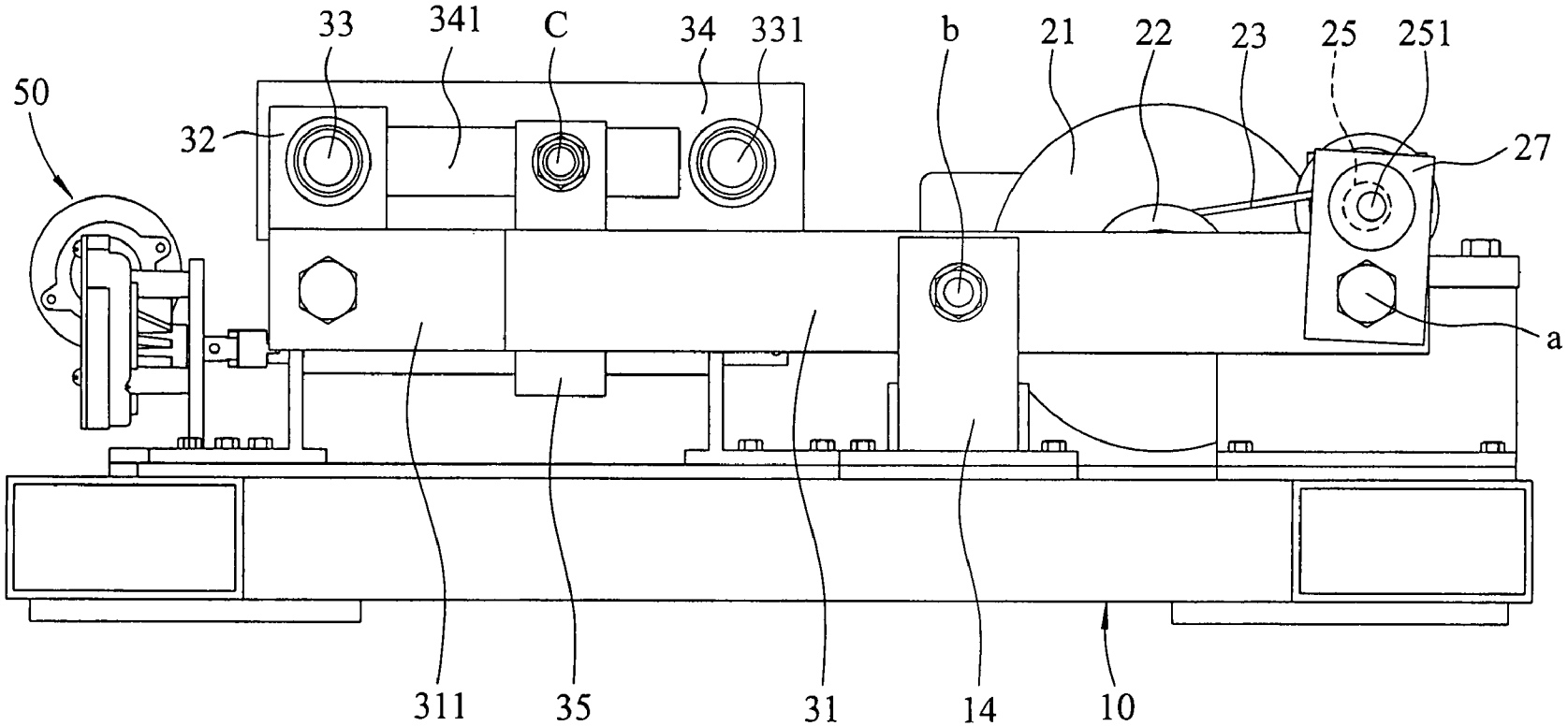
FIGS. 4A~4D are front views showing the movements of a swinging link rod module of a vibration fitness equipment in accordance with the present invention.
Figure 4:
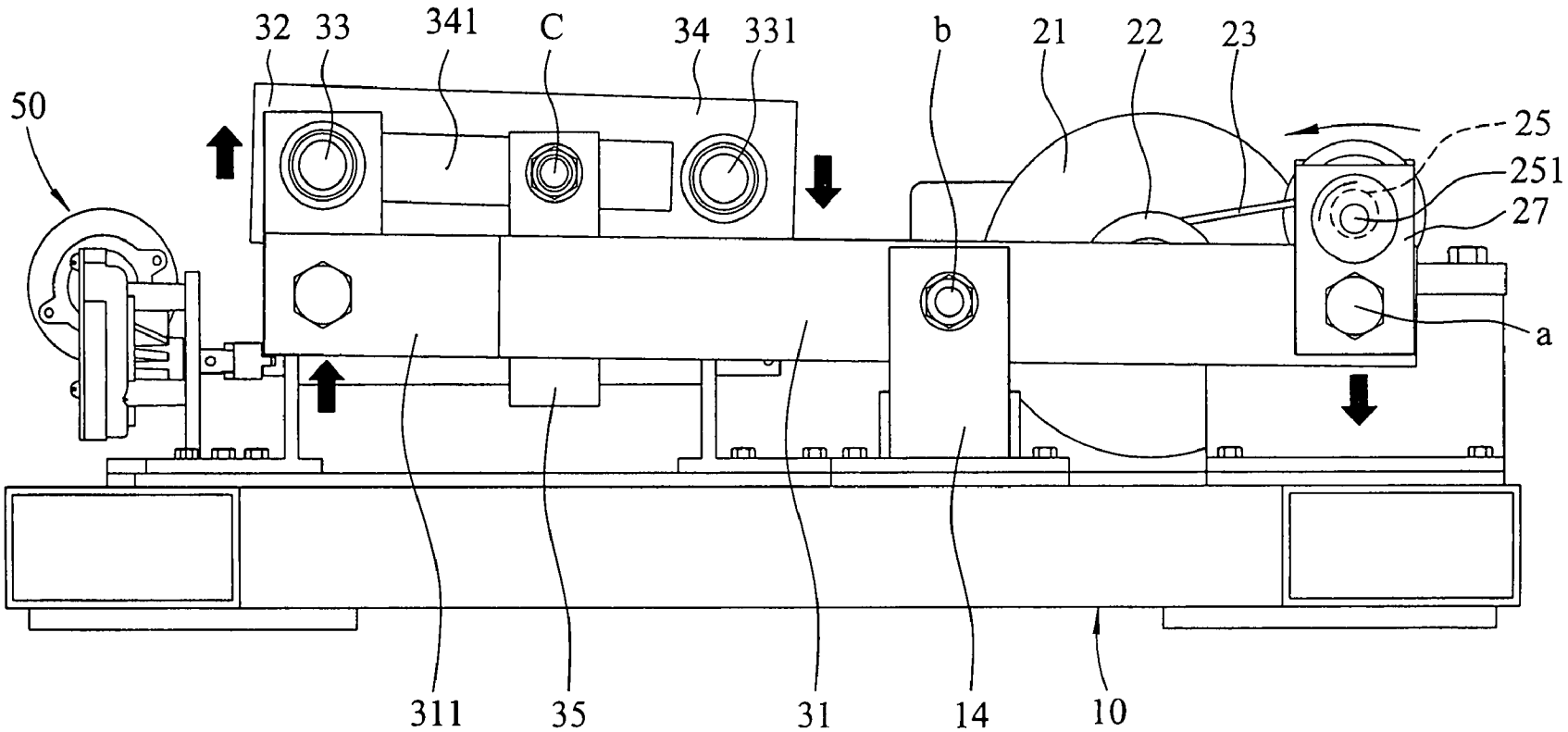
Figure 4:
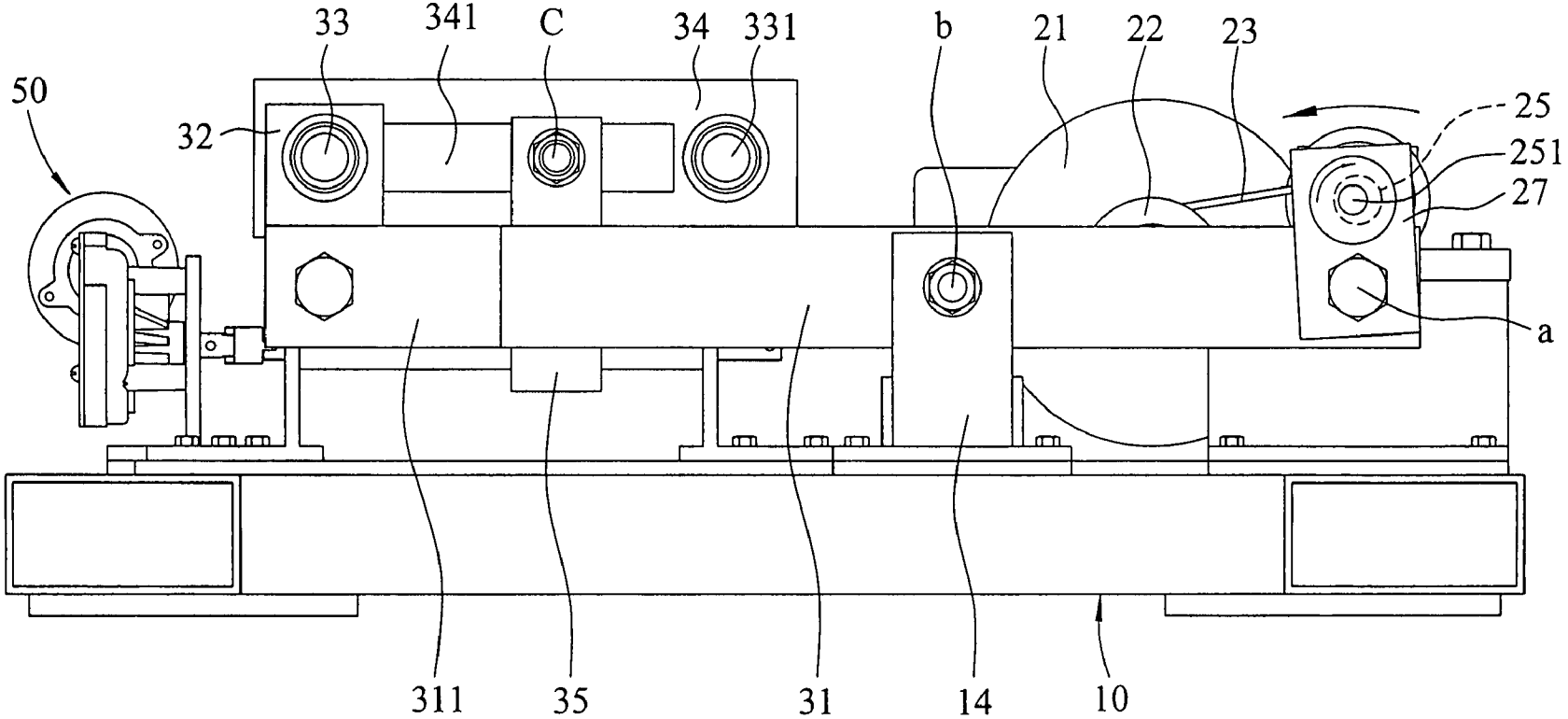
Figure 4:
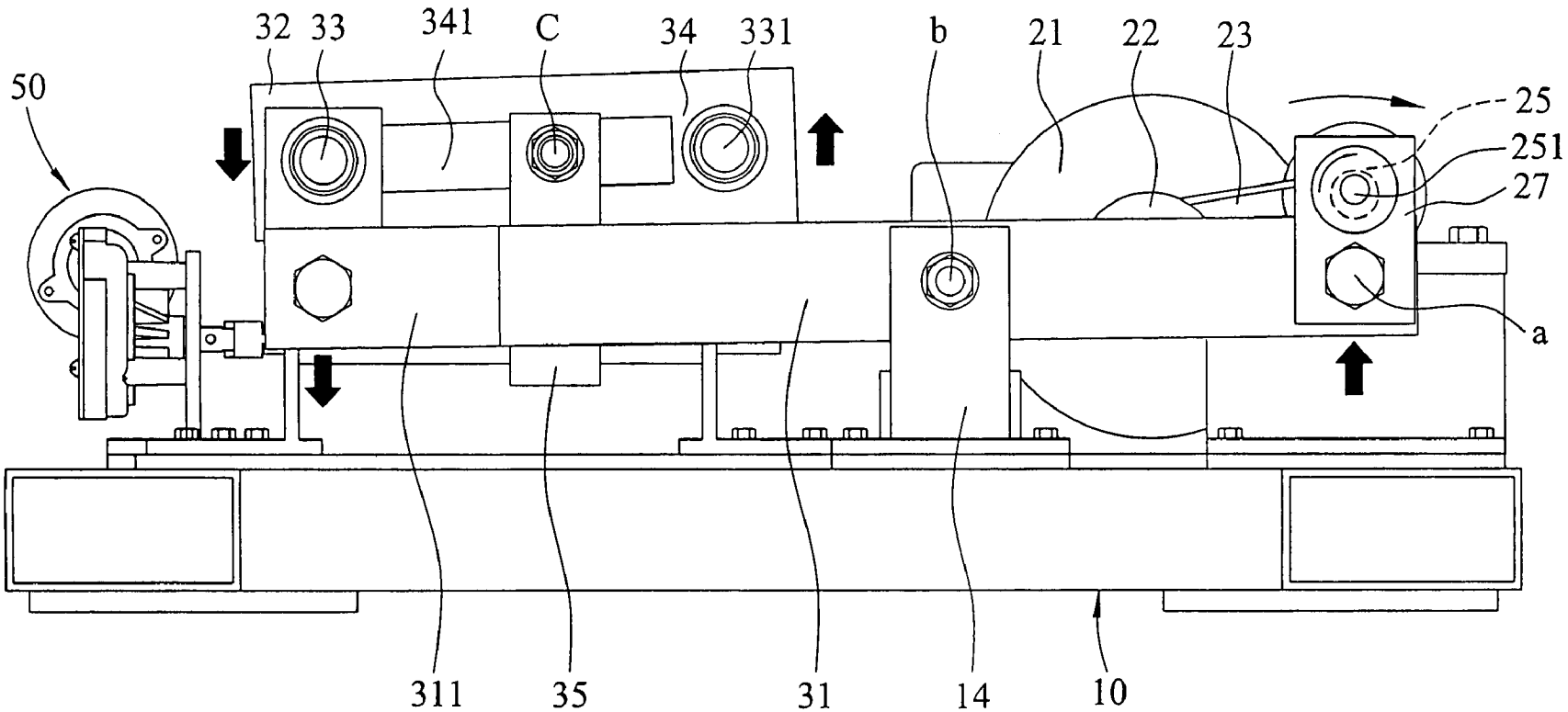
Figure 5:
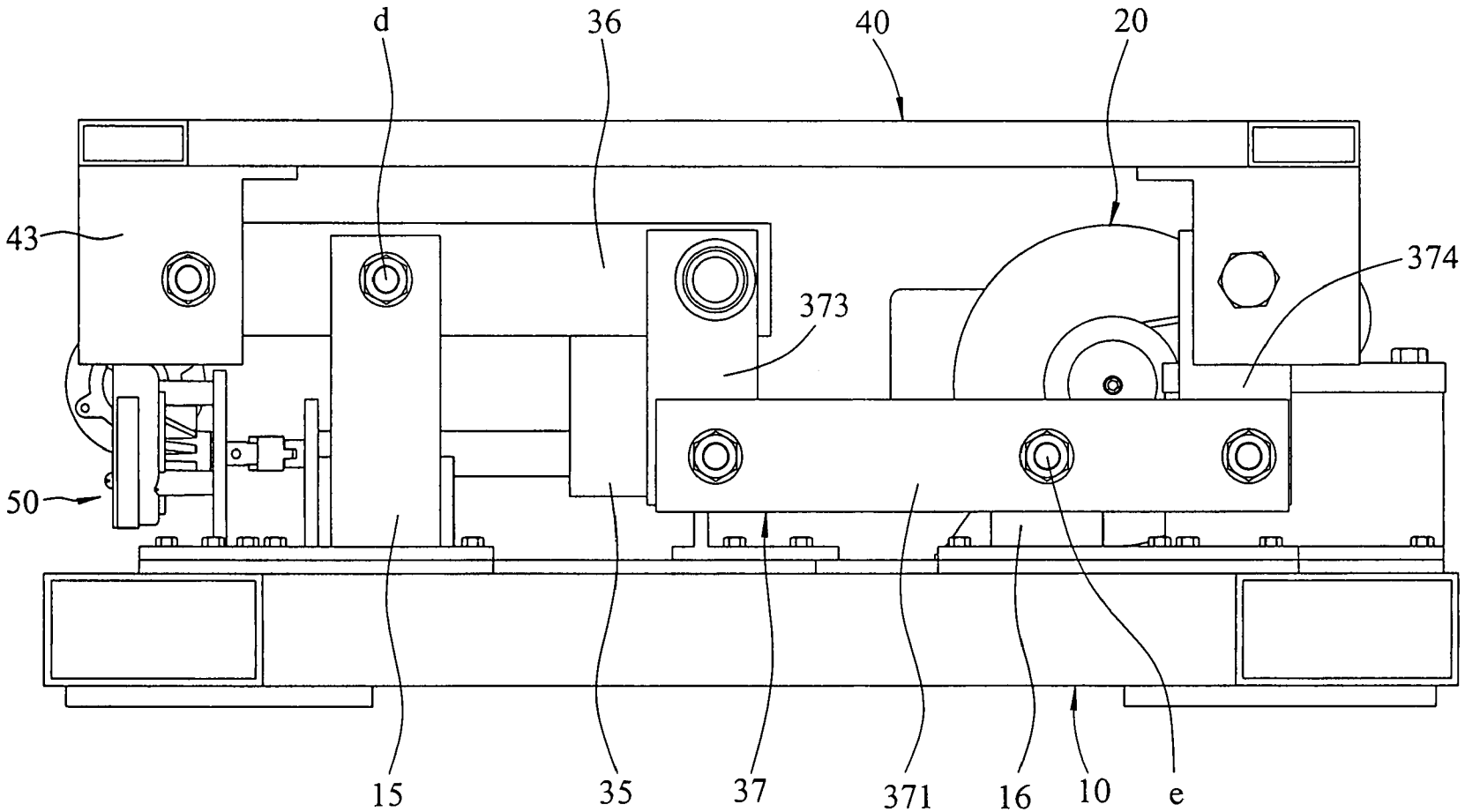
FIGS. 5A~5D are front views showing the movements of a swinging link rod module and a support standard of a vibration fitness equipment in accordance with the present invention.
Figure 5:
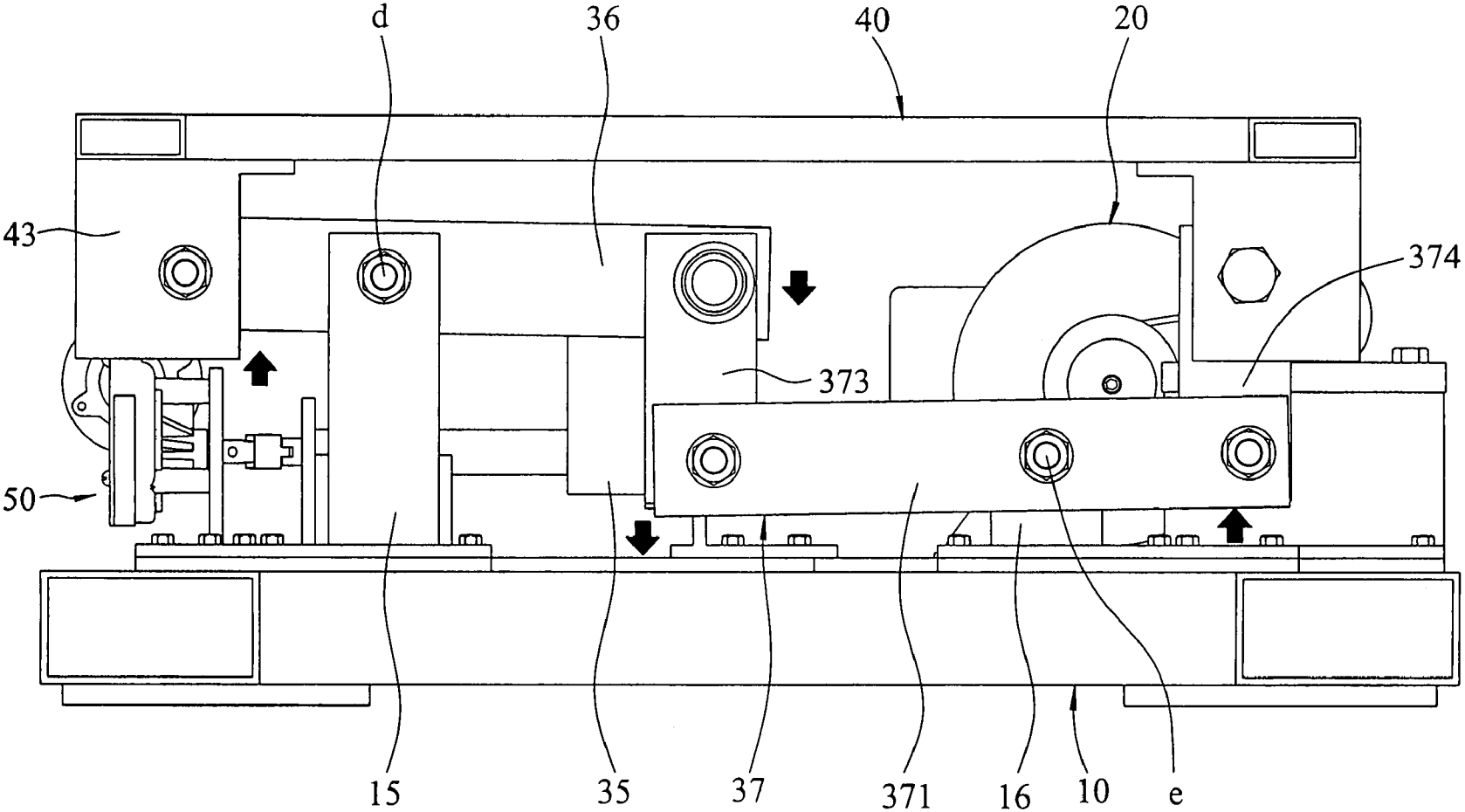
Figure 5:
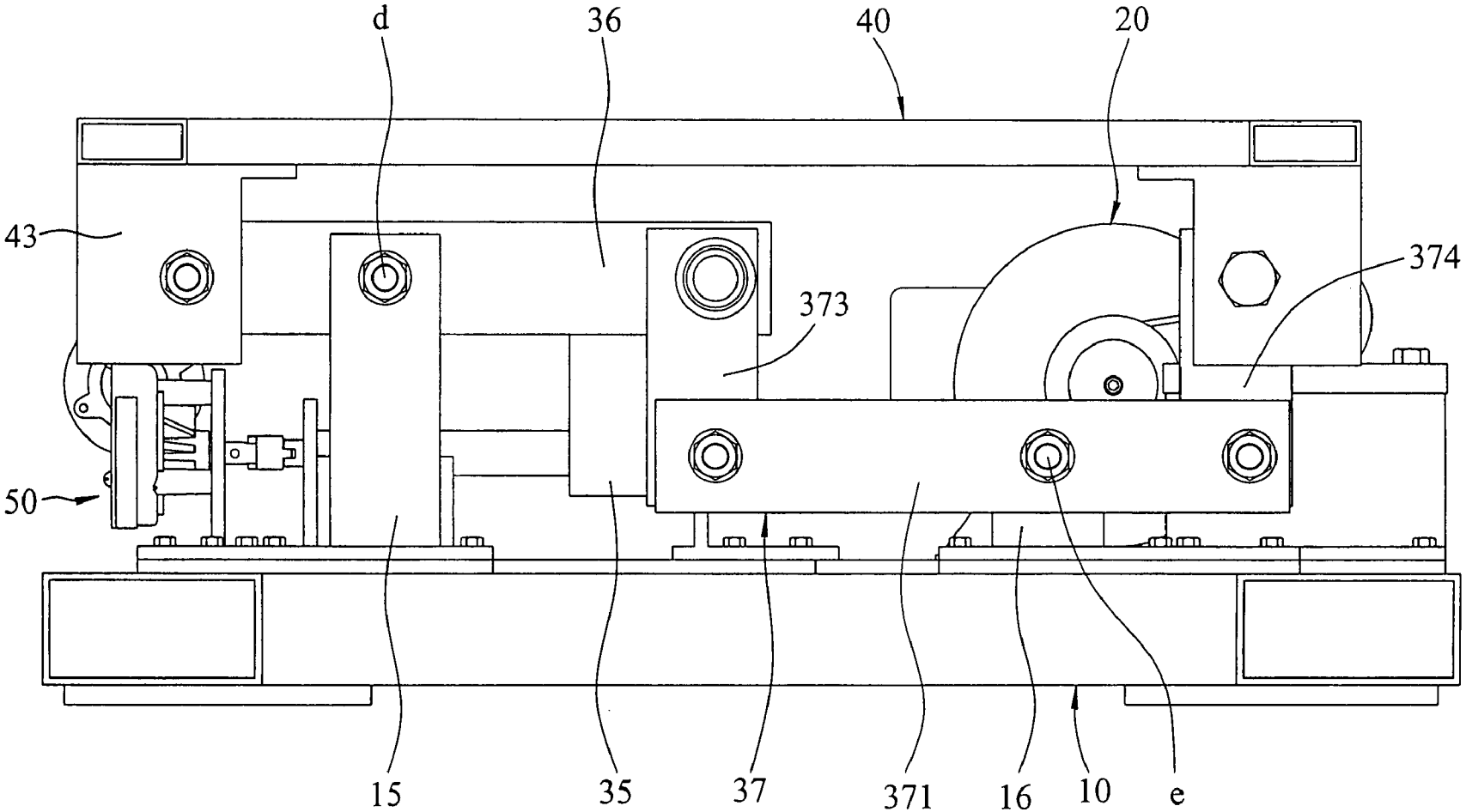
Figure 5:
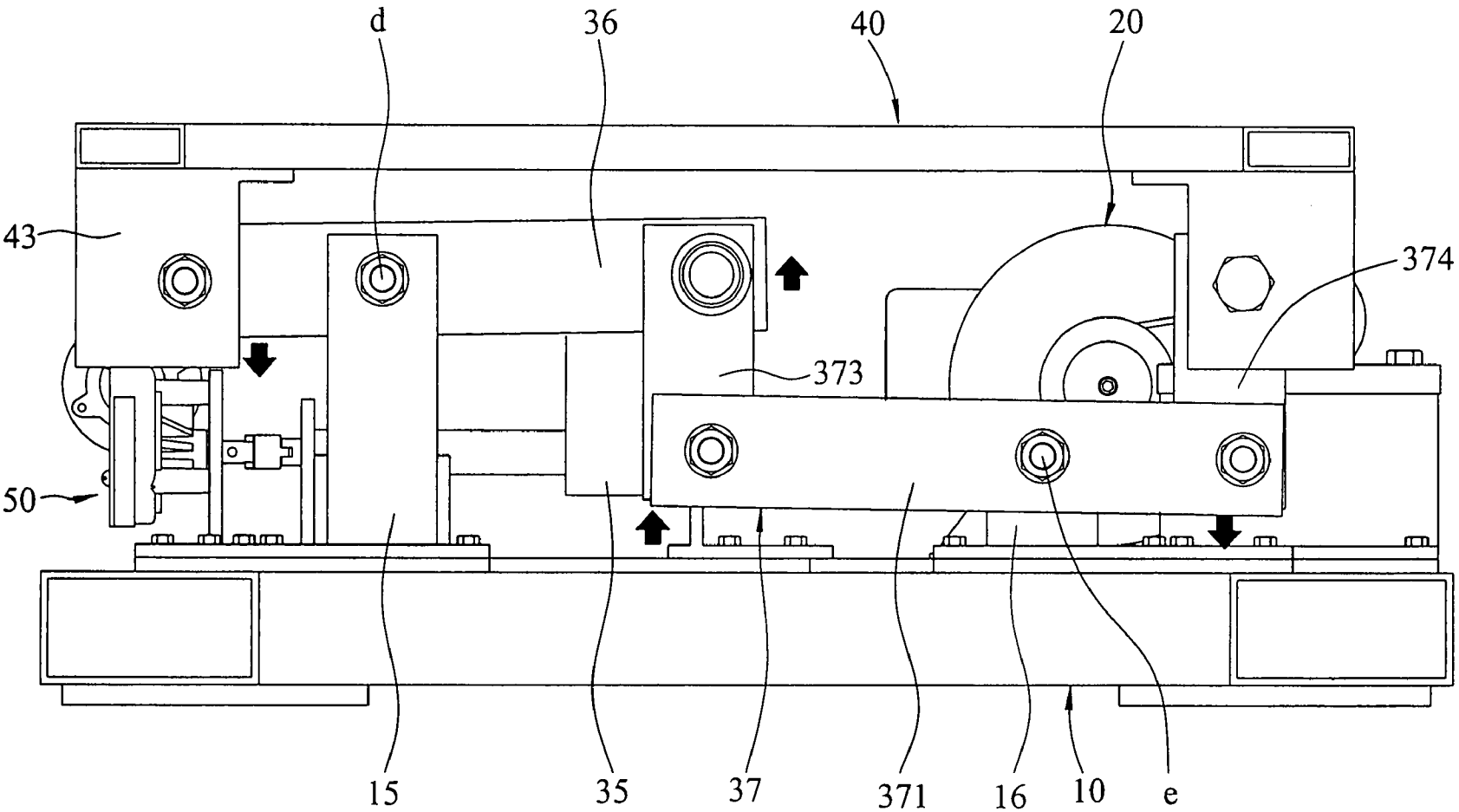

A driving mechanism 20 has a preinstalled program and a circuit for controlling and driving the driving mechanism 20, and the driving mechanism 29 is comprised of a motor 21, a transmission shaft 25 and a driving member module 27. A pulley 22 is installed at the axial position of the motor 21 for connecting a belt 23 with a pulley 24 on the transmission shaft 25, such that the motor 21 can be operated to drive the belt 23 to rotate the transmission shaft 25. An eccentric shaft 251 is protruded separately from both ends of the same side of the transmission shaft 25, and a bearing 26 is installed separately at the positions of front and rear fixing pivotal bases 13 corresponding to the longitudinal frame 12 of the base 10, such that both ends of the transmission shaft 25 are passed through the two bearings 26, and both ends of the eccentric shaft 251 are sheathed into the top of a driving member module 27, and the driving member module 27 is comprised of two rectangular members;

A swinging link rod module 30 is substantially in the shape of a slender board, and formed by pivotally connecting first, second, third and fourth swinging link rods 31, 34, 36, 37, wherein the left end of the front and rear first swinging link rod 31 defines a pivotal connecting end 311 in the form of a U-shaped clamping board, and the middle section of the base 10 has two corresponding pivotal bases 14 respectively and pivotally coupled with the middle section of the first swinging link rod 31 to define a pivotal connecting point b as shown in FIG. 4A, such that the right side of the first swinging link rod 31 is pivotally connected to the bottom of the driving member module 27 to define a pivotal connecting point a, and the U-shape pivotal connecting end 311 is pivotally connected to the bottom of a driving member 32. The driving member 32 is also a rectangular member, such that a pivotal shaft 33 is pivotally connected to the top of two driving members 32, and the pivotal shaft 33 is extended from the left side of the front and rear of the second swinging link rod 34, and the second swinging link rod 34 is substantially a rectangular frame having a track 341 at the middle. A driving base 35 is substantially in a U-shape, and both ends of the driving base 35 have two pivotal connecting boards 351 for pivotally connecting each pivotal connecting board 351 on both ends of the driving base 35 into the track 341 of each second swinging link rod 34 by a sliding member 342 to define a pivotal connecting point c, and a set of limit switches (not shown in the figure) can be installed at the driving bases 35 on both left and right ends of the base 10 for sensing and protecting the origin and the end point. The right side of the second swinging link rod 34 has a longer pivotal shaft 331, such that both ends of the long pivotal shaft 331 are pivotally connected to the right side of the front and rear third swinging link rods 36, and the third swinging link rod 36 is pivotally connected to the middle section of the swinging link rod 34 through the two corresponding pivotal bases 15 disposed on another side of the base 10 to define a pivotal connecting point d as shown in FIG. 5A. The front and rear fourth swinging link rods 37 have a front board 371 and a rear board 372 respectively, and a link board 373, 374 is pivotally connected between both lateral sides of the two boards 371, 372, and the right side of the third swinging link rod 36 is pivotally connected to the link board 373 of the fourth swinging link rod 37, and the middle section of the front board 571 of the fourth swinging link rod 37 is pivotally connected to two corresponding pivotal bases 16 disposed on a lateral side of the base 10 to define a pivotal connecting point e. A support stand 40 is a rectangular frame comprised of a plurality of transversal rods 41 and longitudinal rods 42, and a pivotal connecting module 43 is installed around the bottom, such that two pivotal connecting modules 43 on the left side can be pivotally connected to the left side of the third swinging link rod 36, and the two pivotal connecting modules 43 on the right side can be pivotally connected to the link board 374 on the right side of the third swinging link rod module 37.

An adjusting mechanism 50 has a preinstalled program and a circuit for controlling and driving the adjusting mechanism 50, and a motor 51 installed on a lateral side of the base 10, and the motor 51 is latched and connected to a horizontal screw rod 54 through an axle rod 53 of a decelerating mechanism 52, and another end of the horizontal screw rod 54 includes a pivotal board 55 and pivotally coupled together with the driving base 35 on another pivotal board 551, and an external end of the screw rod 54 is coiled with a sensor (not shown in the figure) for sensing and detecting the number of rounds (or coils) on the screw rod 54. The two pivotal boards 55, 551 are fixed correspondingly and respectively on two longitudinal frames at the middle section of the base 10, and a horizontal axle rod 56 parallel to the horizontal screw rod 54 is pivotally connected between the two pivotal boards.

Each rod is passed or pivotally connected with the swinging link rod module 30 through axle sheathes or other connecting components, and the motor 21 of the driving mechanism 20 transmits the transmission shaft 25 through a gear wheel mechanism, a pulley mechanism or other driving mechanism.

Referring to FIGS. 4A~4D and 5A~5D for schematic views of movements of a vibration training apparatus A in accordance with the present invention, the motor 21 of the driving mechanism 20 drives the belt 23 to rotate the transmission shaft 25, and the eccentric shaft 251 links and drives the driving member 27 to swing sideway as shown in FIGS. 4B and 5B. If the eccentric shaft 251 is turned to ¼ round, the driving member 27 will transmit a pivotal rotation, and the first swinging link rod 31 will use the pivotal connecting point b as a fulcrum to swing both ends of the first swinging link rod 31, such that the left end ascends and the right end descends, and the connecting end 311 on the left side pivotally links to ascend the driving member 32. In the meantime, the second swinging link rod 34 uses the pivotal connecting point c as a fulcrum to swing, such that the left end ascends and the right end descends, and the right side of the pivotal shaft 331 drives the right side of the third swinging link rod 36 to descend the link board 373. The third swinging link rod 36 uses a pivotal connecting point d as a fulcrum to swing, such that the left end ascends and the right ends descends, and the link board 373 drives the fourth swinging link rod 37 to use a pivotal connecting point e as fulcrum to swing, such that the left end descends and the right end ascends. The right side of the link board 374 ascends, so that both left and right sides of the swinging link rod module 30 simultaneously drive the support stand 40 to displace upward. Referring to FIGS. 4C and 5C, if the eccentric shaft 251 is turned to ¾ round, the eccentric shaft drives both ends of the first swinging link rod 31 to return to their horizontal position, and the left side of the link rod 31 drives the pivotal connecting end 311 to ascend the driving member 32, such that the second swinging link rod 34 resumes its original position, and the right side of the pivotal shaft 331 ascends to drive the third swinging link rod 36 and the fourth swinging link rod 37 to resume their original positions, and the left side of the third swinging link rod 36 and the link board 374 on the right side of the fourth swinging link rod 37 displaces downward to resume their original positions. Therefore, both left and right sides of the swinging link rod module 30 drives the support stand 40 to displace downward to resume their original positions. Referring to FIGS. 4D and 5D, if the eccentric shaft 251 is turned to ¾ round, the eccentric shaft 251 will drive the first swinging link rod 31 to use the pivotal connecting point b as a fulcrum, such that the first swinging link rod 51 is swung with a left descended end and a right ascended end, and the pivotal connecting end 311 on the left side drives the driving member 32 to descend and drive the second swinging link rod 34 to use the pivotal connecting point c as a fulcrum, such that the second swinging link rod 34 is swung with a left descended end and a right ascended end. The pivotal shaft 331 on the right also drives the right side of the third swinging link rod 36 and the link board 373 to ascend, such that the third swinging link rod 36 uses the pivotal connecting point d as a fulcrum, and the third swinging link rod 36 is swung with a left descended end and a right ascended end, and the link board 373 drives the fourth swinging link rod 37 to use the pivotal connecting point e as a fulcrum, and the fourth swinging link rod 37 is swung with a left ascended end and a right descended end. The link board 374 on the right side descends, such that both left and right sides of the swinging link rod module 30 can simultaneously drive the support stand 40 to displace downward. Referring to FIGS. 4A and 5A, if the eccentric shaft 251 is rotated and returned to its original position, the eccentric shaft 251 will drive both ends of the first swinging link rod 31 to resume their horizontal position. The left side of the pivotal connecting end 311 drives the driving member 32 to ascend and resume the second swinging link rod 34 to its original position, and the right side of pivotal shaft 331 descends to drive the third swinging link rod 36 and the fourth swinging link rod 37 to resume their original positions, so that the left side of the third swinging link rod 36 and the link board 374 on the right side of the fourth swinging link rod 37 displace upward to resume their original positions, and both left and right sides of the swinging link rod module 30 drive the support stand 40 to displace upward to resume its original position. In the present invention, the driving mechanism 20 drives the eccentric shaft 251 of the transmission shaft 25 to turn (in the same direction) repeatedly and locate precisely at the top and the bottom of the transmission shaft 25, such that the swinging link rod module 30 can produce vertically up-and-down vibrations and swings, and the support stand 40 can produce unceasing up-and-down displacements.

Figure 6:
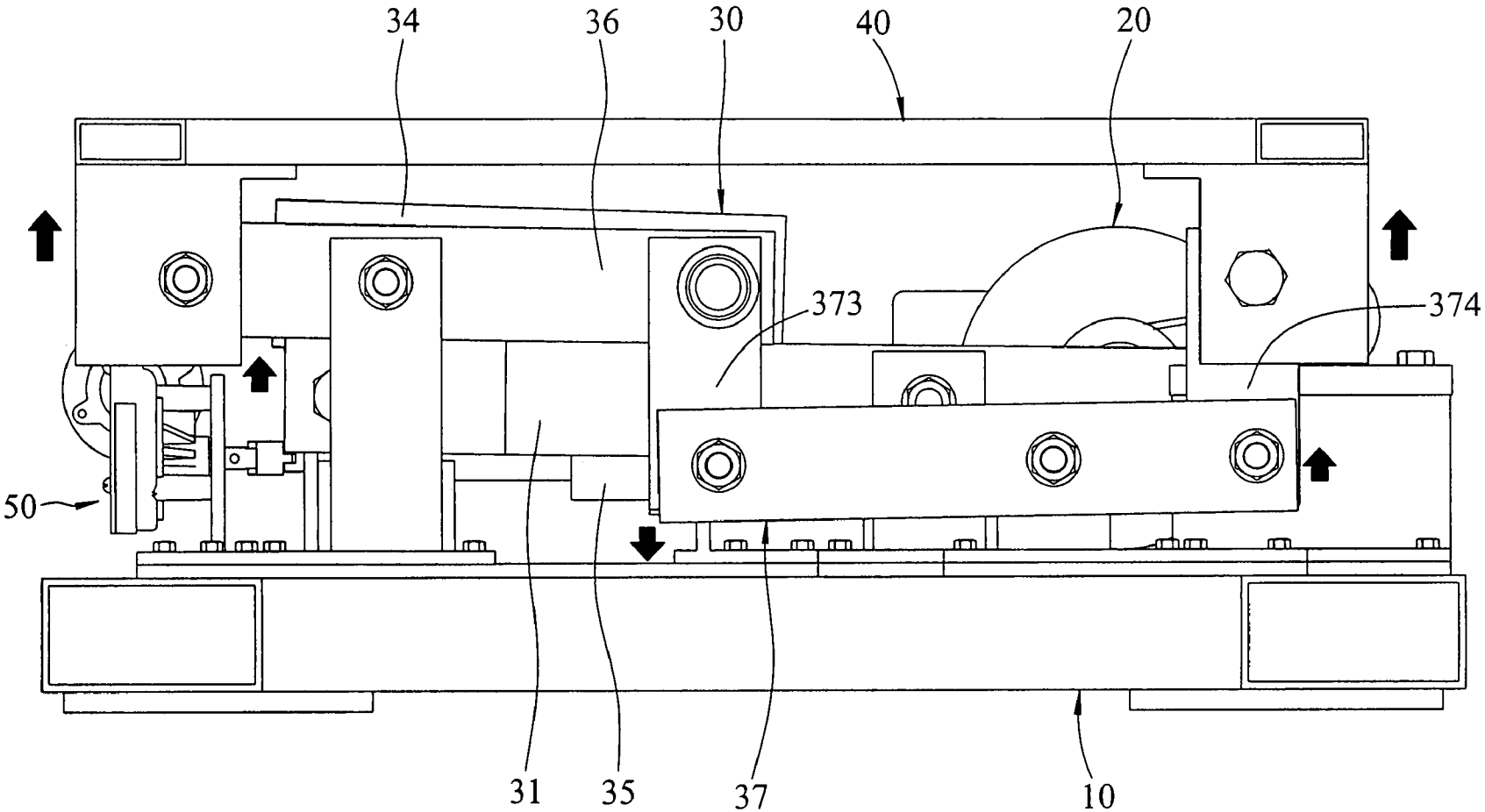
FIGS. 6A and 6B are front views showing the movements of a vibration fitness equipment in accordance with the present invention.
Figure 6:
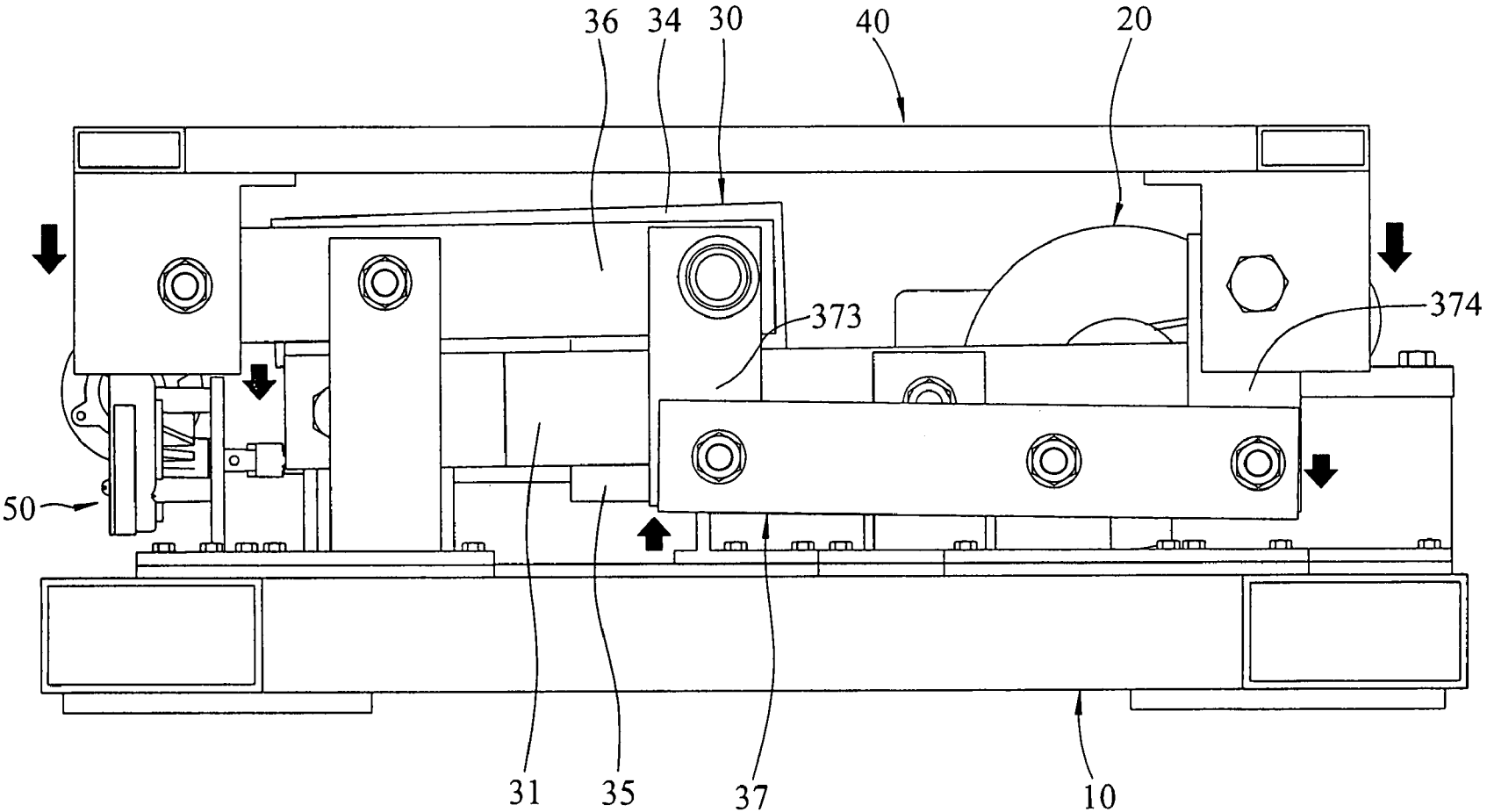

With the forgoing link rod movement as shown in FIGS. 6A and 6B, the driving mechanism 20 drives each swinging link rod of the swinging link rod module 30 to produce linear vibrations during the swinging process and matches the rotation speed of the motor 21 to produce up-and-down displacements with various different frequencies for the support stand 40, so as to form a whole-body vibration training apparatus capable of linearly changing its vibration amplitude.

Referring to FIGS. 7, 8, 9A and 9B, the motor 51 of the adjusting mechanism 50 is operated to drive the decelerating mechanism 52 to rotate the screw rod 54, so that a relative displacement is produced between the driving base 35 and the screw rod 54, and stopped by limit switches installed on both sides of the driving base 35, and the sliding member 342 and the pivotal connecting board 351 generate sideway displacements in the track 341 of the second swinging link rod. In other words, the pivotal connecting point c is displaced sideway with respect to the base 10. By the principle of lever, when the fulcrum (which is the pivotal connecting point c in this case) is displaced to the left, the distance of the rod on the right side of the fulcrum becomes longer, such that if the driving mechanism 20 drives the left side (with a shorter distance) of the second swinging link rod 34 to swing, the longer rod distance on the right side can produce a large swinging distance to increase the swinging amplitude of the swinging link rod module 30. On the other hand, if the fulcrum (which is the pivotal connecting point c in this case) is adjusted and displaced to the right side, the distance of the rod on the right side of the fulcrum becomes shorter, such that when the driving mechanism 20 drives the longer rod on the left side of the second swinging link rod 34 to swing, the shorter distance of the rod on the right side produces a small swing distance to decrease the swinging amplitude of the swinging link rod module 30, so as to form an adjusting mechanism capable of changing the swinging amplitude s well as changing the vibration amplitude of the whole-body vibration training apparatus.

Figure 7:
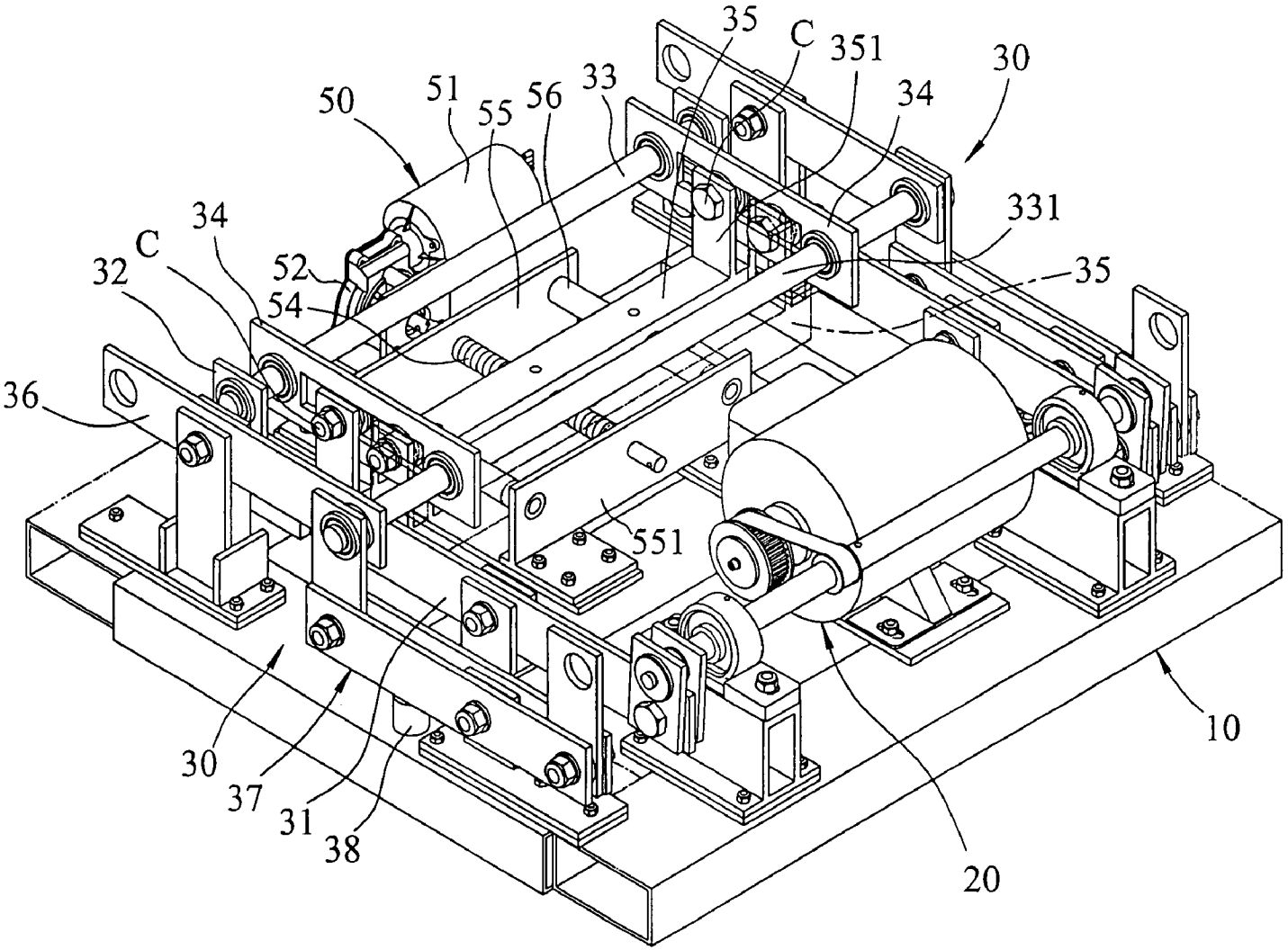
FIG. 7 is a schematic perspective view of adjusting an adjusting mechanism in accordance with the present invention.
Figure 8:
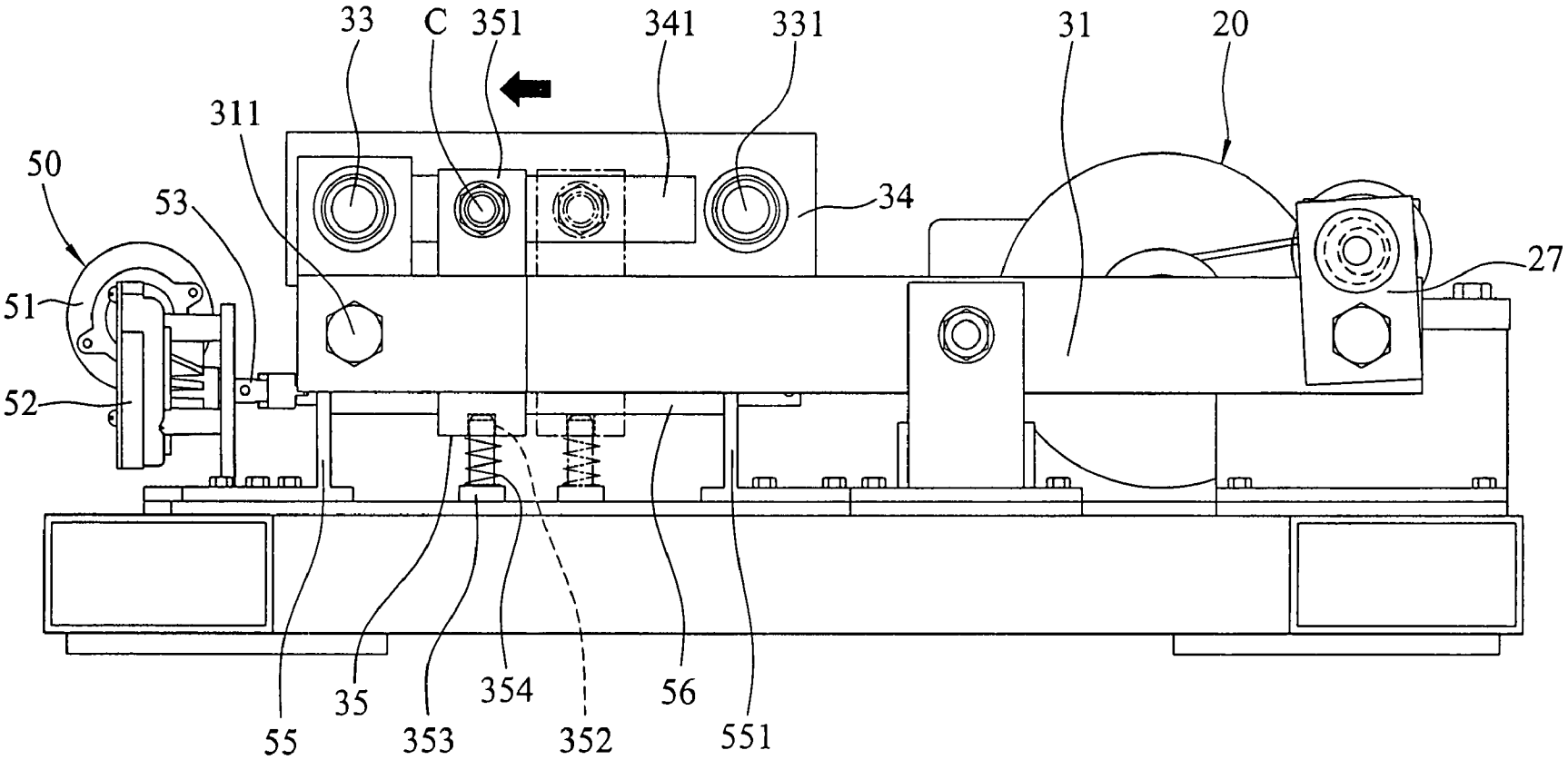
FIG. 8 is a front view of adjusting an adjusting mechanism in accordance with the present invention.
Figure 9:
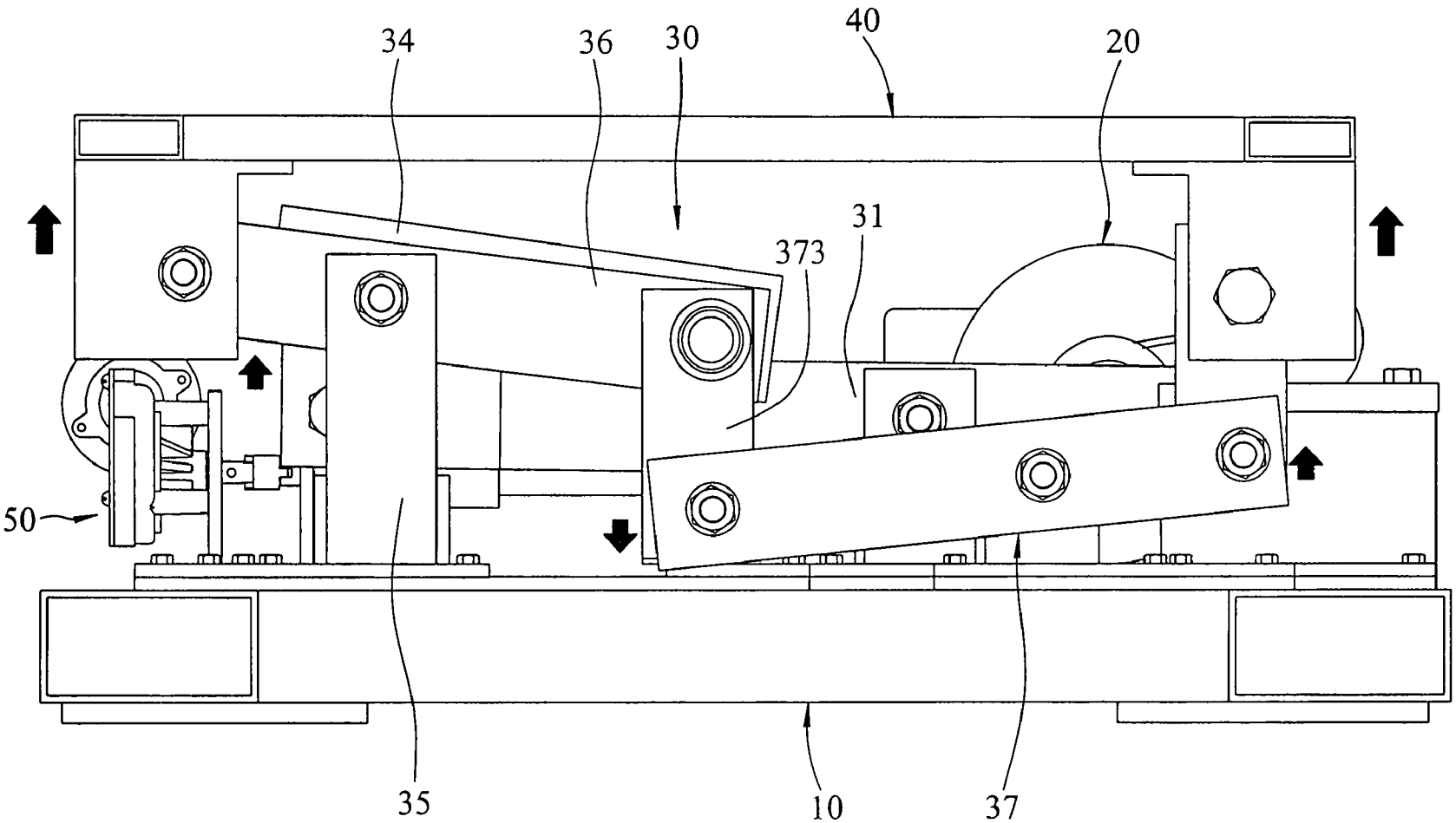
FIGS. 9A and 9B are schematic views of the movements of a vibration fitness equipment capable of changing its vibration amplitude in accordance with the present invention.
Figure 9:
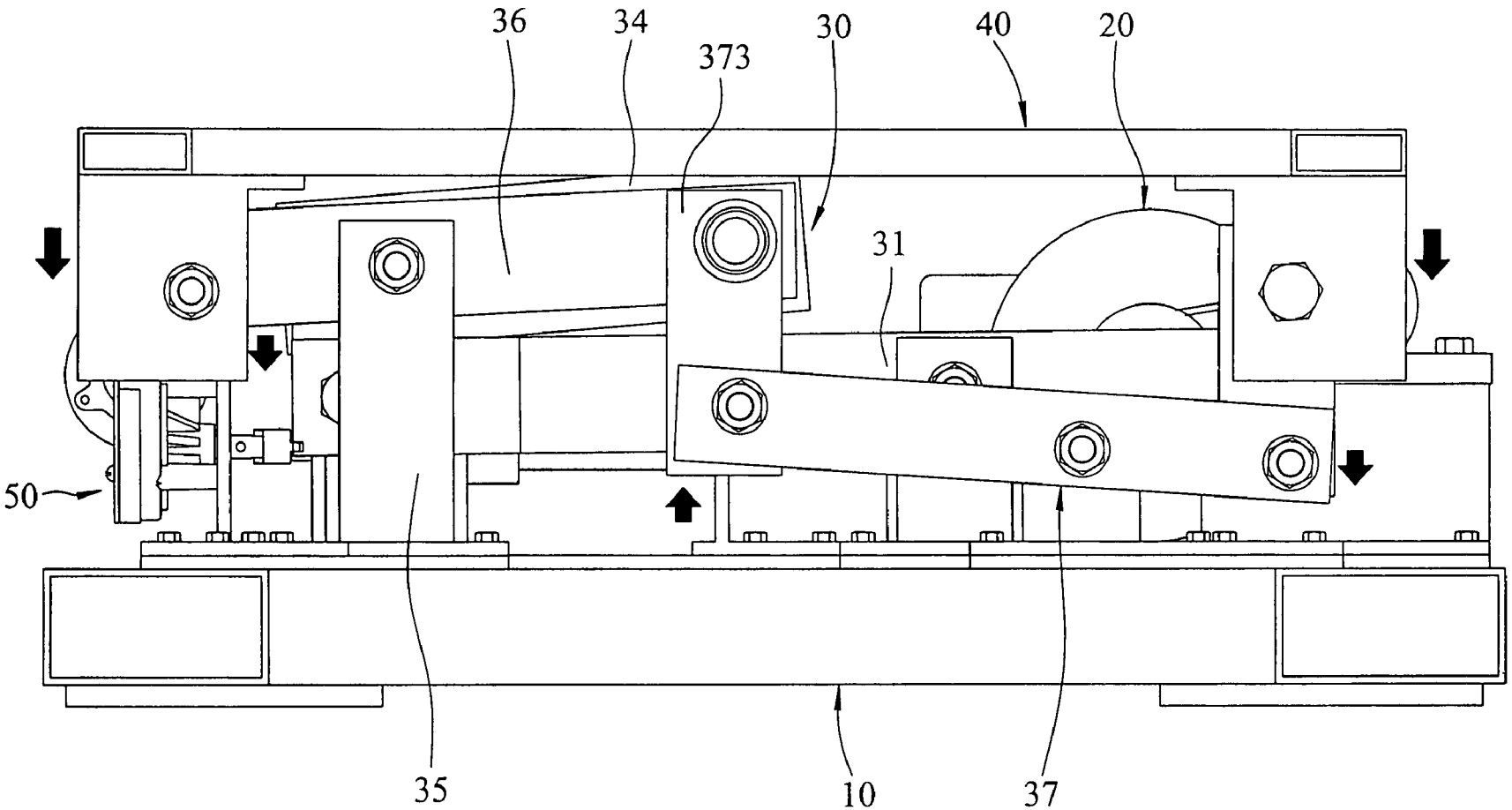

Referring to FIG. 7, a shock absorbing element 38 can be installed under the front and rear boards 371, 372 of the fourth swinging link rod 37, and the shock absorbing 38 can be a rubber, a spring or any other plastic resilient component for providing a shock absorption effect for the swinging link rod module 30. Referring to FIG. 8, a groove hole 352 is disposed under the bottom base of the driving base 35, such that the top of an axial pillar 353 sheathed with a resilient component 354 can be extended into the groove hole 352 to form a pre-compressed spring structure that can slid together with the driving base 35 and provide a shock absorption effect for sliding the driving base 35.

Figure 10:
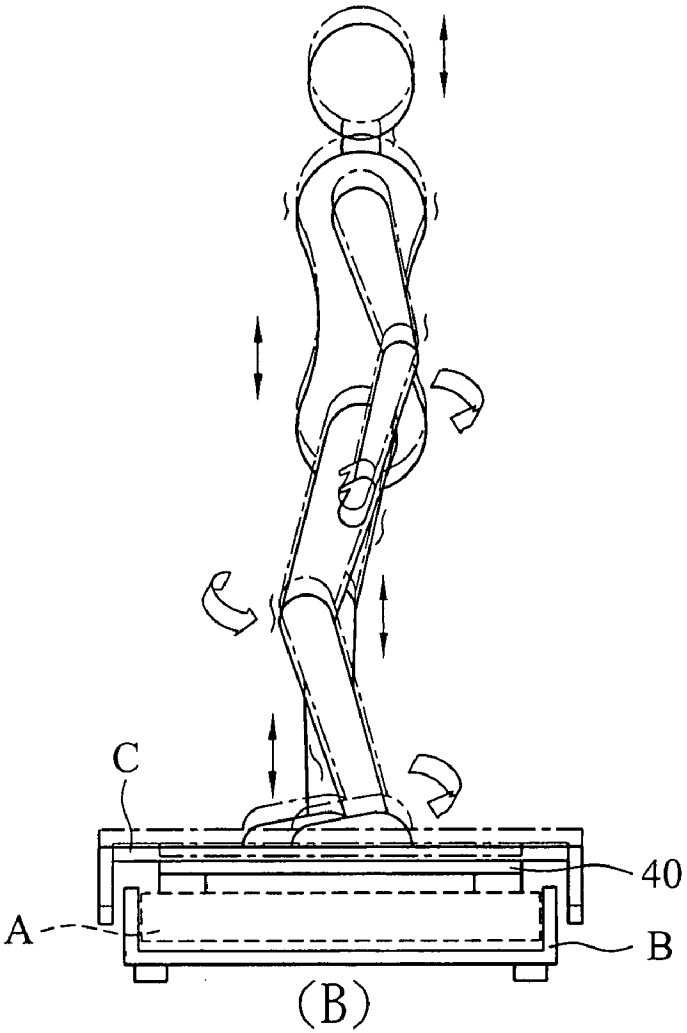
FIGS. 10A and 10B are a front view and a side view of a vibration fitness equipment being used on a human body respectively in accordance with the present invention.
Figure 10:
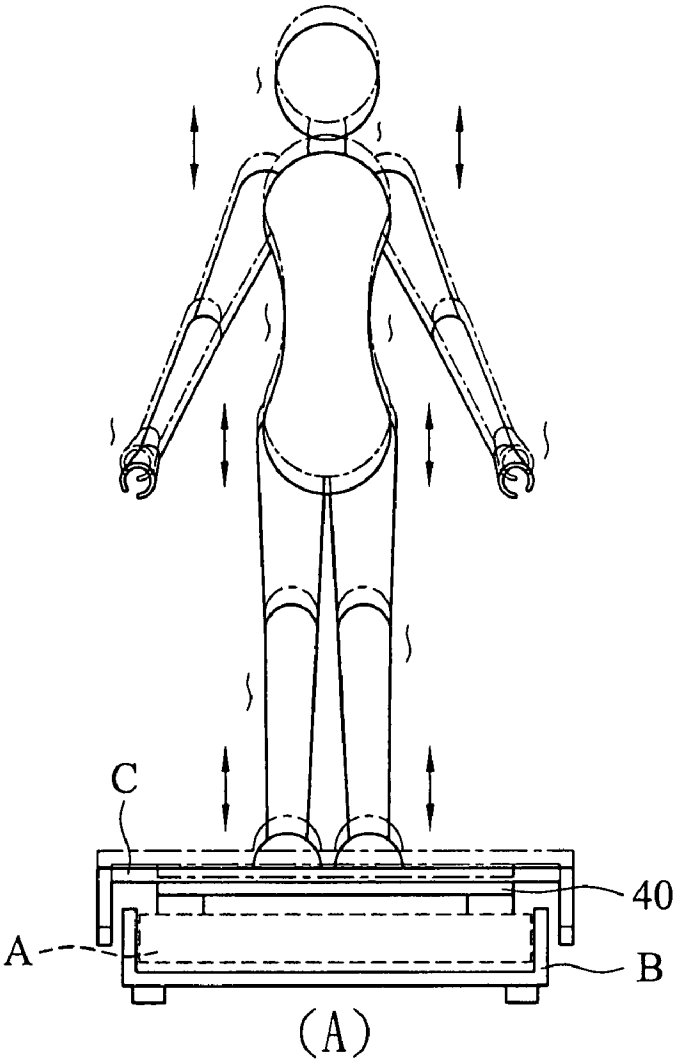
Figure 11:
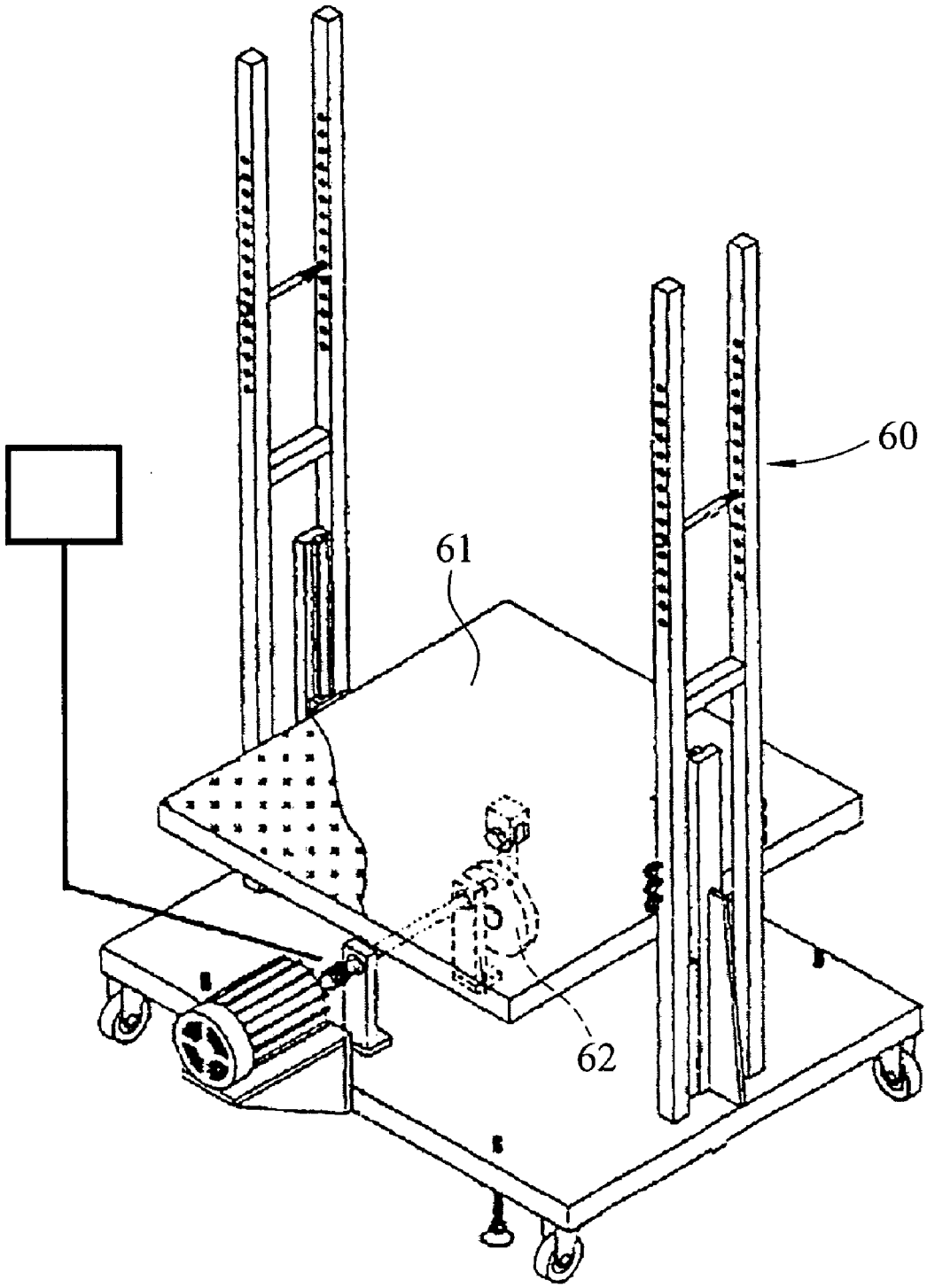
FIG.11 PRIOR ART
FIG. 11 is a schematic view of an external look of the first prior art.
Figure 12:
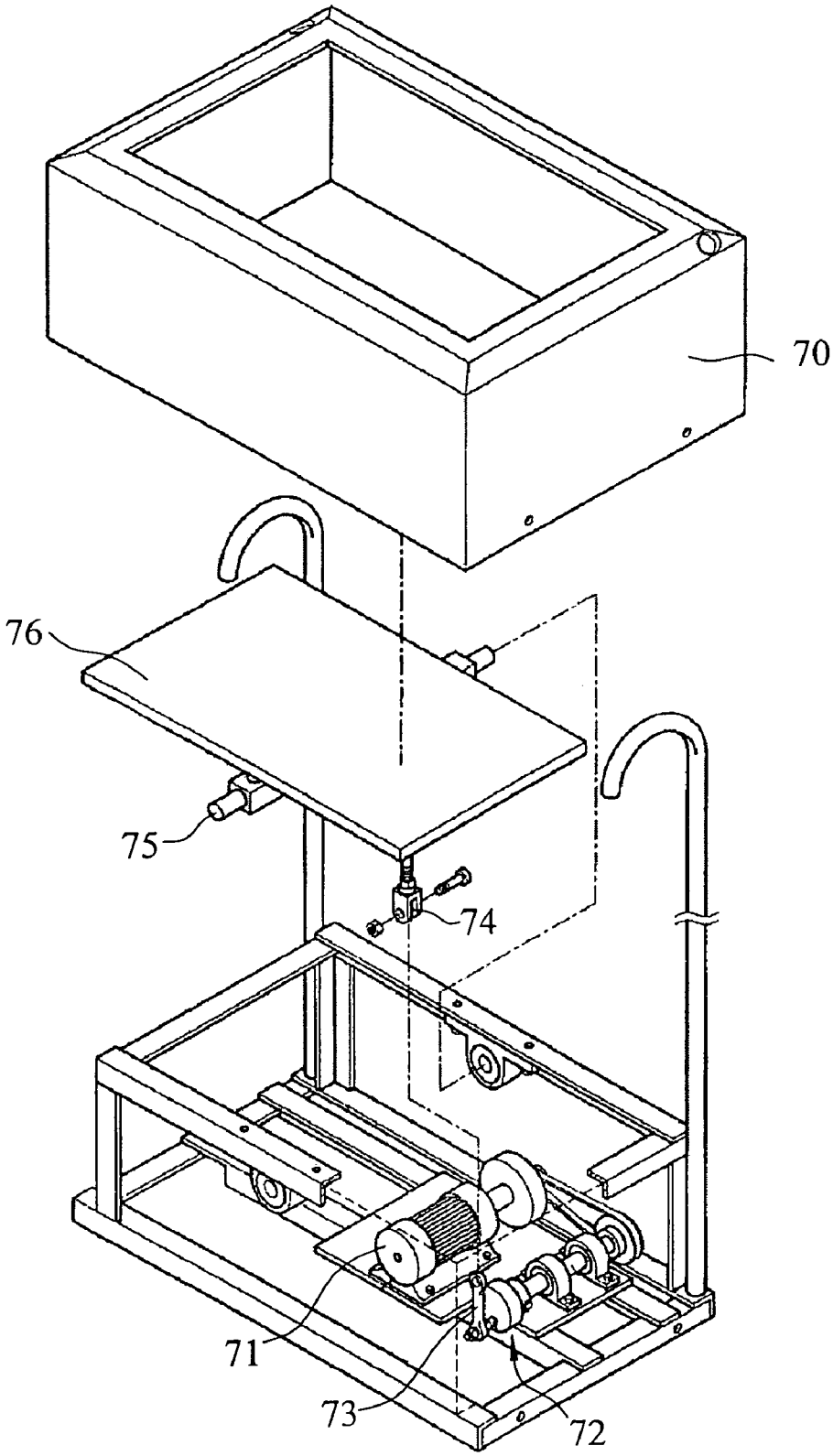
FIG.12 PRIOR ART
FIG. 12 is an exploded view of the second prior art.
Figure 13:
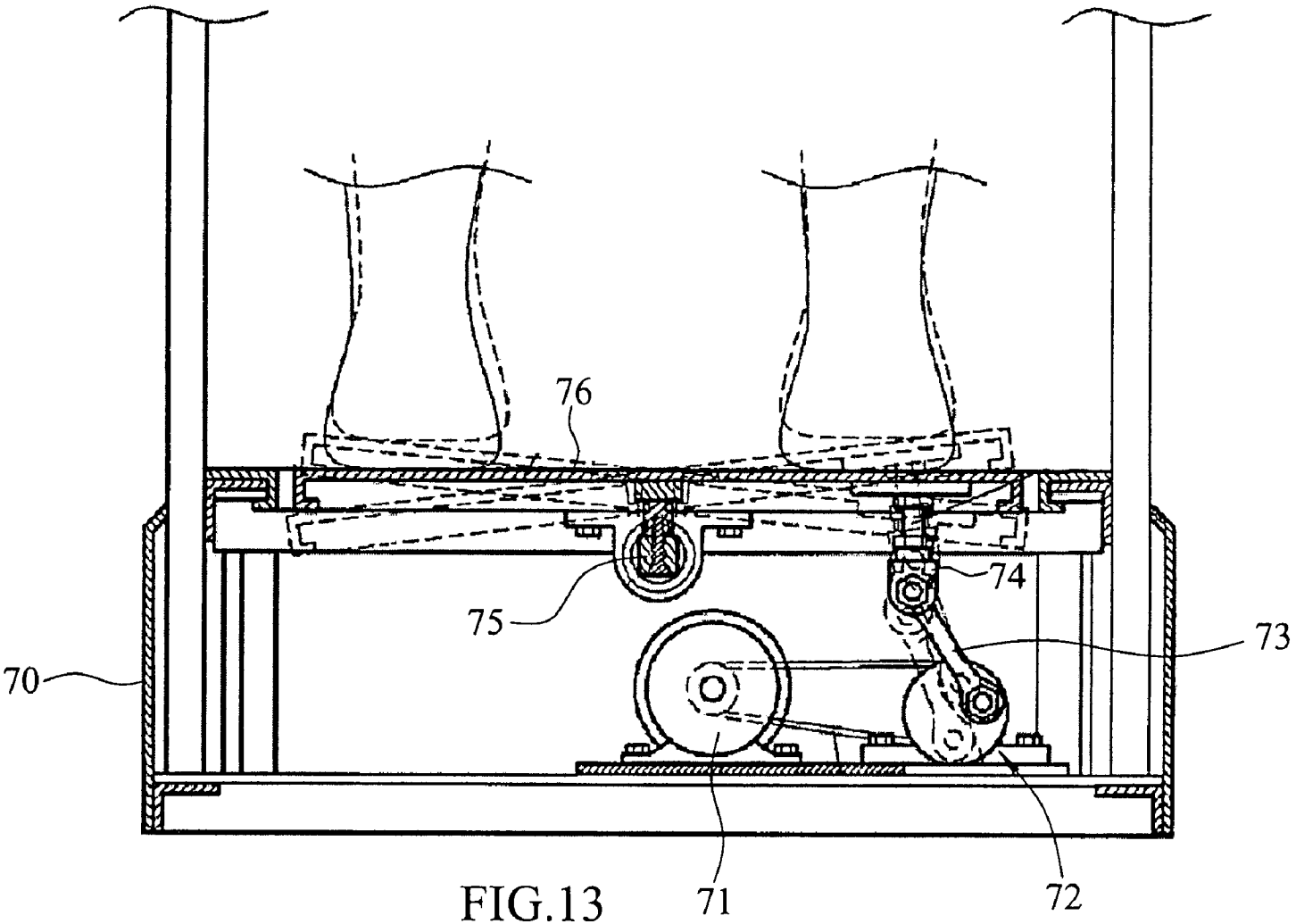
FIG.13 PRIOR ART
FIG. 13 is a schematic view of vibrations applied to a human body in accordance with the second prior art.

Referring to FIGS. 10A and 10B for a preferred embodiment of the present invention, the vibration training apparatus A includes an external casing base B for protruding the support stand 40 out from the surface of the base B, and a treadle structure C on the surface of the support stand 40 provided for a user to stand, so as to achieve the whole-body vibration training effect.

With the foregoing components, the vibration training apparatus A of the invention uses the driving mechanism 20 to drive the swinging link rod module 30 to produce a linear vibration during the swinging process, and matches the rotation speed of the motor 21 to produce up-and-down displacements with different frequencies for the support stand 40. The adjusting mechanism 50 changes the vibration amplitude of the swinging link rod module 30 to provide a whole-body vibration effect to stimulate internal organs, and produce a resonant effect for organs and muscles of our body, so as to achieve the effects of keeping a good health, improving our blood circulation, relaxing ourselves, and training our muscles, as well as quickly improving the muscle strength and muscle endurance. Therefore, the vibration training apparatus of the invention is applicable for general weight training or physical therapy.

What is claimed is:

1. A vibration training apparatus comprising:

a base including a plurality of transversal frames and longitudinal frames;

a driving mechanism having a program and a circuit for controlling and driving the driving mechanism, and an eccentric shaft driven by the driving mechanism for driving a swinging link rod module installed on the base, the swinging link rod module having a plurality of swinging link rods and a support stand disposed on the base;

the driving mechanism driving the swinging link rod module to produce a linear vibration during a swinging process and matching with a rotational speed of a motor to drive the support stand to produce vertically up-and-down displacements with vibrations of different frequencies, the swinging link rod module is formed substantially by a slender board by pivotally connecting front and rear of first, second, third and fourth swinging link rods, and a middle section of the first swinging link rod is pivotally connected to a pivotal base on the base; such that the right side of the first swinging link rod is pivotally connected to a driving member module which is pivotally connected to the eccentric shaft of the driving mechanism, and the left side of the first swinging link rod is pivotally connected to the left side of the second swinging link rod by a driving member, and both right and left sides of the fourth swinging link rod are respectively and pivotally connected to a link board, and the right side of the second swinging link rod is pivotally connected to the right side of the third swinging link rod and the link board at the left side of the fourth swinging link rod by a pivotal shaft, the left side of the third swinging link rod and the link board at the right side of the fourth swinging link rod are respectively and pivotally connected to the support stand.

2. A vibration training apparatus comprising:

a base formed by connecting a plurality of transversal frames and longitudinal frames, and having a swinging link rod module pivotally coupled thereon;

a driving mechanism having a program and a circuit for controlling and driving the driving mechanism, and an eccentric drive driven by the driving mechanism for driving the swinging link rod module installed on the base to produce a link rod movement;

the swinging link rod module having a plurality of swinging link rods and a support stand disposed on the base; and an adjusting mechanism connected between the base and the swinging link module so as to change the swinging amplitude of the swinging link rod module, the adjusting mechanism includes a motor disposed on a lateral side of the base, and the motor is latched and connected by an axle rod and a screw rod of a decelerating mechanism, and two pivotal boards fixed on the base and a driving base is connected from another end of the screw rod, and the driving base is in an U-shape having two ends, with each end of the driving base slidably connected to a track of one of the swinging link rod that is pivotally connected to the base, and the motor drives the driving base and the screw rod to produce a relative displacement of the swinging link rod module to drive and adjust a fulcrum of the swinging link rod module on the base to produce horizontal left and right displacements, so as to change from the lower position to a higher position of the fulcrum of the swinging link rod module.

3. The vibration training apparatus as claimed in claim 2, wherein the driving mechanism comprises a motor, a transmission shaft a driving member module, and the eccentric drive, the eccentric drive being formed by a pair of eccentric shafts respectively formed on both ends of the transmission shaft, both eccentric shafts are sheathed;

into the driving member module and the driving member module is pivotally coupled with one of the swinging link rod, the motor drives the transmission shaft and the swinging link rods module to produce a link rod movement.

4. The vibration training apparatus as claimed in claim 2, wherein the driving mechanism comprises a motor, a transmission shaft a driving member module, and the eccentric drive, the eccentric drive being formed by a pair of eccentric shafts respectively formed on both ends of the transmission shaft, such that both ends of the transmission shaft are pivotally coupled onto the base and both eccentric shafts are sheathed into the driving member module, the driving member module is pivotally coupled with one of the swinging link rods, the motor drives the transmission shaft to rotate and the swinging link rod module to produce a link rod movement.

5. The vibration training apparatus as claimed in claim 2, wherein the driving mechanism comprises a motor, a transmission shaft and a driving member module, and a gear wheel mechanism, a pulley mechanism or another driving mechanism is installed between the motor and the transmission shaft.

6. The vibration training apparatus as claimed in claim 2, wherein the support stand is a rectangular frame comprised of a plurality of transversal rods and longitudinal rods.

7. The vibration training apparatus as claimed in claim 2, further comprising a casing base installed around the exterior of the training apparatus, such that the support stand is extended out from the surface of casing base, and a treadle structure installed on the surface of the support stand and provided for a user to stand to achieve the effect of a whole-body vibration training.

* * * * *